US008201935B2

(12) United States Patent
Ohshima et al.

(10) Patent No.: US 8,201,935 B2
(45) Date of Patent: Jun. 19, 2012

(54) IMAGE RECORDING METHOD

(75) Inventors: Tohru Ohshima, Atsugi (JP); Kiyofumi Nagai, Machida (JP)

(73) Assignee: Ricoh Company, Limited, Tokyo (JP)

( * ) Notice: Subject to any disclaimer, the term of this patent is extended or adjusted under 35 U.S.C. 154(b) by 315 days.

(21) Appl. No.: 12/683,644

(22) Filed: Jan. 7, 2010

(65) Prior Publication Data

US 2010/0194837 A1 Aug. 5, 2010

(30) Foreign Application Priority Data

Feb. 2, 2009 (JP) ..... 2009-021162

(51) Int. Cl.
*B41J 2/01* (2006.01)

(52) U.S. Cl. ..... 347/102; 347/16; 347/17

(58) Field of Classification Search ..... 347/16, 347/17, 102, 104
See application file for complete search history.

(56) References Cited

U.S. PATENT DOCUMENTS

| | | | |
|---|---|---|---|
| 5,431,720 | A | 7/1995 | Nagai et al. |
| 5,462,592 | A | 10/1995 | Murakami et al. |
| 5,514,208 | A | 5/1996 | Nagai et al. |
| 5,622,550 | A | 4/1997 | Konishi et al. |
| 5,810,915 | A | 9/1998 | Nagai et al. |
| 5,879,439 | A | 3/1999 | Nagai et al. |
| 5,882,390 | A | 3/1999 | Nagai et al. |
| 5,972,082 | A | 10/1999 | Koyano et al. |
| 5,993,524 | A | 11/1999 | Nagai et al. |
| 6,120,589 | A | 9/2000 | Bannai et al. |
| 6,231,652 | B1 | 5/2001 | Koyano et al. |
| 6,261,349 | B1 | 7/2001 | Nagai et al. |
| 6,613,136 | B1 | 9/2003 | Arita et al. |
| 6,637,875 | B2 | 10/2003 | Kaneko et al. |
| 6,688,737 | B2 | 2/2004 | Nagai et al. |
| 6,695,443 | B2 | 2/2004 | Arita et al. |
| 6,730,149 | B2 | 5/2004 | Arita et al. |
| 6,730,155 | B2 | 5/2004 | Gotoh et al. |
| 6,786,588 | B2 | 9/2004 | Koyano et al. |
| 6,899,751 | B2 | 5/2005 | Arita et al. |

(Continued)

FOREIGN PATENT DOCUMENTS

JP 11-277724 10/1999

(Continued)

OTHER PUBLICATIONS

U.S. Appl. No. 12/095,614, filed May 30, 2008, Tohru Ohshima, et al.

(Continued)

*Primary Examiner* — Daniel Petkovsek
(74) *Attorney, Agent, or Firm* — Oblon, Spivak, McClelland, Maier & Neustadt, L.L.P.

(57) ABSTRACT

The image recording method includes ejecting an ink to form an image on the surface of a recording layer of a recording medium; and then applying a glossiness imparting liquid on the surface of the recording medium. The ink includes a particulate colorant, a surfactant and water, and has a solid content of not lower than 6% by weight. The recording layer is located overlying a substrate including cellulose pulp as a main component and includes an inorganic pigment and a styrene-butadiene copolymer. The surface of the recording medium bearing the recording layer absorbs the ink in an amount of from 1 ml/m$^2$ to 10 ml/m$^2$ before coating the glossiness imparting liquid when the ink absorbing amount is measured with a dynamic scanning absorptometer at a contact time of 500 ms.

8 Claims, 7 Drawing Sheets

U.S. PATENT DOCUMENTS

| | | | | |
|---|---|---|---|---|
| 6,918,662 | B2 | 7/2005 | Arita et al. | |
| 7,033,013 | B2 | 4/2006 | Koyano et al. | |
| 7,094,813 | B2 | 8/2006 | Namba et al. | |
| 7,278,726 | B2 | 10/2007 | Nagai | |
| 7,279,506 | B2 | 10/2007 | Sisler et al. | |
| 7,284,851 | B2 | 10/2007 | Bannai et al. | |
| 7,370,952 | B2 | 5/2008 | Inoue et al. | |
| 7,374,608 | B2 | 5/2008 | Arita et al. | |
| 2006/0176349 | A1 | 8/2006 | Nagai et al. | |
| 2007/0197685 | A1 | 8/2007 | Aruga et al. | |
| 2007/0221078 | A1 | 9/2007 | Namba et al. | |
| 2007/0221079 | A1 | 9/2007 | Aruga et al. | |
| 2008/0070008 | A1 | 3/2008 | Namba et al. | |
| 2008/0117273 | A1* | 5/2008 | Yamashita et al. | 347/96 |
| 2008/0138519 | A1 | 6/2008 | Habashi et al. | |
| 2008/0248260 | A1 | 10/2008 | Kojima et al. | |
| 2008/0254228 | A1 | 10/2008 | Kojima et al. | |
| 2008/0273045 | A1 | 11/2008 | Morohoshi et al. | |
| 2008/0302268 | A1 | 12/2008 | Arita et al. | |
| 2009/0043028 | A1 | 2/2009 | Matsuyama et al. | |
| 2009/0098312 | A1 | 4/2009 | Goto et al. | |
| 2009/0114121 | A1 | 5/2009 | Morohoshi et al. | |
| 2009/0130313 | A1 | 5/2009 | Ohshima et al. | |
| 2009/0130320 | A1* | 5/2009 | Kawakami et al. | 427/387 |
| 2009/0162569 | A1 | 6/2009 | Morohoshi et al. | |
| 2009/0176070 | A1 | 7/2009 | Goto et al. | |
| 2009/0186162 | A1 | 7/2009 | Namba et al. | |
| 2009/0239044 | A1 | 9/2009 | Habashi et al. | |
| 2009/0258196 | A1 | 10/2009 | Nagashima et al. | |
| 2009/0263632 | A1 | 10/2009 | Kojima et al. | |
| 2009/0291213 | A1 | 11/2009 | Ohshima et al. | |

FOREIGN PATENT DOCUMENTS

| | | |
|---|---|---|
| JP | 2004-330570 | 11/2004 |
| JP | 2005-329713 | 12/2005 |
| JP | 2008-137369 | 6/2008 |

OTHER PUBLICATIONS

U.S. Appl. No. 12/301,933, filed Nov. 21, 2008, Tohru Ohshima, et al.

U.S. Appl. No. 12/376,439, filed Feb. 5, 2009, Hidefumi Nagashima, et al.

U.S. Appl. No. 12/377,016, filed Feb. 10, 2009, Hiroshi Gotou, et al.

* cited by examiner

IMAGE RECORDING METHOD

BACKGROUND OF THE INVENTION

1. Field of the Invention

The present invention relates to an image recording method for forming an image on a recording medium using an ink.

2. Discussion of the Background

Inkjet recording methods have advantages such that color images can be easily recorded; and the running costs are relatively low. Therefore, various research and development concerning recording devices, recording methods, inks and recording media have been made. As for the recording medium, swelling type recording media and void-structure type recording media have been developed. Among these recording media, void-structure type recording media are mainly used because of being superior in ink drying speed.

Void-structure type recording media typically have a structure such that an ink absorbing layer having voids for absorbing ink droplets is located on a substrate, and an optional porous gloss layer is located on the ink absorbing layer. Since the recording media have such a structure, the recording media have not only excellent ink absorbing property but also a combination of glossiness and appearance quality better than those of conventional photographic papers, and can produce high definition images. However, since fillers having a large oil absorption (i.e., a large specific surface area) have to be used as the filler included in the ink absorbing layer of the void-structure type recording media to impart good transparency to the ink absorbing layer, a large amount of expensive filler such as silica, alumina hydrates, colloidal silica has to be used, resulting in increase of costs of the recording media. In addition, since the method for preparing such void-structure type recording media is complex, the recording media have much higher costs than conventional photographic papers.

In addition, inkjet recording media have another drawback such that images formed thereon are damaged relatively easily compared to photographic images. This is because the photographic images are formed in a coloring layer of a photographic paper, which layer is located in an inner portion of the paper and is covered with a protective layer (i.e., gelatin layer). Therefore, even when photographic images are strongly rubbed, the images are hardly damaged. In contrast, in the case of inkjet recording media, images are formed on the surface or in a surface portion of the recording media. Therefore, it is difficult for the images formed on such inkjet recording media to have the same durability (i.e., resistance to rubbing) as that of photographic images. Among various images recorded by inkjet recording methods, images recorded by dye inks, which tend to penetrate into recording media, have relatively good rubbing resistance. However, since images recorded by pigment inks tend to be present on the surface of the outermost layer of recording media, the images have relatively poor rubbing resistance compared to the dye ink images.

Recently, in addition to consumer applications, inkjet recording methods need to be used for applications for small amount of copies, and variable print applications (such as commercial photographic printing) such that a document is distributed to persons while changing the contents of the document. However, because of the drawbacks mentioned above, the inkjet recording methods cannot fulfill the needs for costs and durability. Therefore, inkjet recording methods are not widely used, although high quality images can be produced thereby.

In contrast, offset printing methods, which use a lipophilic ink, are used for commercial printing fields because cast coated papers, which are glossy like photographic papers and which have low costs, can be used as the recording medium. The reason why cast coated papers have low costs is that the materials used for the coating layer thereof have very low costs, and the method for preparing the cast coated papers are relatively simple (i.e., the method has a high productivity) compared to the method for preparing the recording media used for inkjet printing. These cast coated papers are designed assuming that images are formed thereon by offset printing.

When images are formed on such cast coated papers by inkjet printing, the inks are not absorbed well, thereby causing problems such that the recorded images blur, and it takes a long time until the recorded images dry. Therefore, cast coated papers cannot be used as recording media for inkjet printing. In addition, since cast coated papers do not include a cationic fixing material, images recorded thereon by inkjet printing have low reliability. Specifically, problems in that recorded images are blurred when contacted with water; and recorded images are faded by ozone are caused.

In addition, since the colorants included in recorded images tend to stay on the surface of cast coated papers, problems in that the even when slightly rubbed, the images are damaged (i.e., the colorants peel off the cast coated papers, resulting in disappearance of the images, change of the color of the images, or transfer of the colorants to other portions of the images) are caused.

In commercial printing, the printed images are typically required to have good abrasion resistance and high glossiness. Therefore, UV coating tends to be performed on the recording media. Specifically, recording media used for commercial printing typically have a transparent layer, which is prepared by applying a so-called UV varnish, i.e., an OP (Over Print) varnish including an UV crosslinkable material. Since UV varnishes can be quickly dried by an UV lamp, the UV varnishes are widely used for printing fields. Since UV LEDs having low power consumption have been developed now, the devices can be used for crosslinking the coated layer instead of UV lamps. Therefore, an increasing need exists for such UV varnishes.

Published unexamined Japanese patent application No. (hereinafter referred to as JP-A) 2004-330570 discloses a printing device having a pre-treatment processing section configured to prepare an ink receiving layer on a recording medium; an inkjet processing section configured to perform inkjet recording; and a post-treatment processing section configured to apply an UV varnish on the recording medium bearing the recorded image thereon. However, when an UV varnish is applied on an ink receiving layer formed on a recording medium, the following problems tend to be caused:

(1) A uniform layer cannot be formed by applying a UV varnish on such an ink receiving layer (i.e., the resultant recording medium has uneven appearance); and (2) The UV varnish applied on such an ink receiving layer cannot be well crosslinked (i.e., the coated UV varnish remains on the ink receiving layer without being crosslinked), thereby causing problems in that the recording medium is tacky, and emits foul smell.

JP-A 2005-329713 discloses a technique in that an UV crosslinkable liquid having a low viscosity is ejected from an inkjet nozzle to form an overcoat layer. This technique is preferably used for forming a glossy portion in a print, but is unavailable for a case where the glossing treatment is performed at a high speed on the entire surface of recording media bearing a recorded image thereon. When this technique is used for inkjet recording, the following problems are caused:

(1) The glossiness of the resultant recorded image (or the recording medium) is low, and therefore a large amount of coating liquid is needed to impart a high glossiness to the recorded image, resulting in increase of the running costs; and (2) The resultant overcoat layer is imperfectly crosslinked.

Thus, this technique cannot be used for inkjet printing, which is required to produce prints at low costs.

JP-A 11-277724 discloses a technique in that after an image is formed on a recording medium having poor ink absorbing property, UV coating is performed thereon. However, when a recording medium having poor ink absorbing property is used, ink images formed thereon blur and/or are not quickly dried particularly when pigment-type aqueous inks are used. Specifically, when pigment-type aqueous inks are used, clear images cannot be formed because images formed on a recording medium, which are not dried perfectly, are blurred by the overcoat layer coating liquid applied thereon. Thus, this technique cannot be practically used.

As mentioned above, it is considered to be difficult to prepare a print by combining the techniques of offset printing, inkjet recording, and OP varnish treatment (particularly UV varnish treatment). Specifically, it is difficult to form a glossy print (like photographic prints) at low costs using a method, in which after the background thereof is printed by offset printing, an image (such as figure images) is formed thereon by inkjet recording, and then an OP varnish treatment is performed thereon.

Because of these reasons, a need exists for a recording method, which can produce high quality images, which have a good combination of glossiness and abrasion resistance like photographic prints, at low costs.

SUMMARY OF THE INVENTION

As an aspect of the present invention, an image recording method is provided. The image recording method includes the following steps:

(1) ejecting an ink, which includes a particulate colorant, a surfactant and water and which has a solid content of not lower than 6% by weight, to form an image on a recording layer of a recording medium, which layer is located overlying a substrate including cellulose pulp as a main component and which includes an inorganic pigment and a styrene-butadiene copolymer, wherein the surface of the recording medium absorbs the ink in an amount of from 1 $ml/m^2$ to 10 $ml/m^2$ when the ink absorbing amount is measured with a dynamic scanning absorptometer at a contact time of 500 ms; and (2) then applying a glossiness imparting liquid on the surface of the recording layer.

In this regard, "overlying" can include direct contact and allow for one or more intermediate layers.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
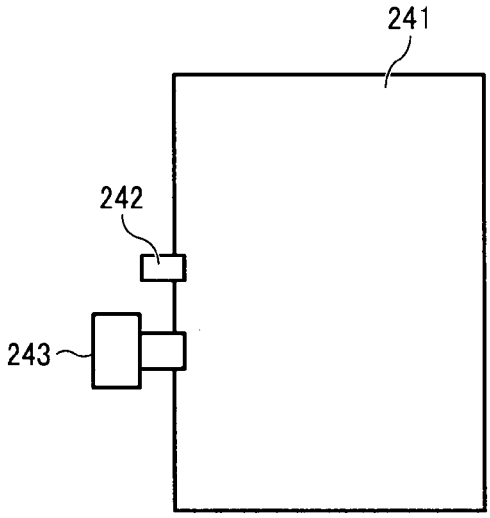
FIG. 1 is a schematic view illustrating an ink cartridge for use in the image recording method of the present invention.

The present inventors have investigated inkjet recording methods, by which high-quality and highly reliable prints like photographic prints can be produced at a high speed and low costs. As a result, the present inventors discover that by using a combination of a pigment ink having a relatively high penetrating ability and a glossiness imparting liquid (particularly, an UV varnish), high-quality and highly reliable images can be formed even on a recording medium having a high glossiness and a low ink permeability.

The image recording method of the present invention includes the following steps:

(1) ejecting an ink, which includes a particulate colorant, a surfactant and water and which has a solid content of not lower than 6% by weight, to form an image on a surface of a recording layer of a recording medium, which is located overlying a substrate including cellulose pulp as a main component and which includes an inorganic pigment and a styrene-butadiene copolymer, wherein the surface of the recording medium absorbs the ink in an amount of from 1 $ml/m^2$ to 10 $ml/m^2$ when the ink absorbing amount is measured with a dynamic scanning absorptometer at a contact time of 500 ms; and (2) then applying a glossiness imparting liquid on the surface of the recording medium.

The glossiness imparting liquid preferably includes an UV crosslinkable material. In this case, it is preferable that the image recording method further includes a step of irradiating the surface of the recording medium with ultraviolet light to crosslink the UV crosslinkable material.

The amount of the ink absorbed by the surface of the recording medium is preferably from 5 $ml/m^2$ to 7 $ml/m^2$.

The glossiness imparting liquid preferably has a viscosity of not lower than 10 mPa·s at 25° C.

The ink preferably has a surface tension of from 15 mN/m to 30 mN/m.

The surfactant is preferably a fluorine-containing surfactant.

The surface of the recording medium preferably has a glossiness of not lower than 50% after the glossiness imparting liquid is applied when the glossiness is measured at an angle of 60° by the method defined in JIS-ZS-8741.

At first, the ink for use in the image recording method of the present invention will be explained in detail.

The ink for use in the present invention is developed to be used for recording media having relatively low ink absorbing property. Specifically, the ink has a lower surface tension than conventional inkjet inks. Therefore, the ink has good wettability, and the carrier fluid included in the ink has good penetrating ability into recording media having low ink absorbing property. The ink has a property such that even when a small amount of carrier included in the ink penetrates into recording medium, the viscosity of the ink greatly increases. Therefore, even on a recording medium having such low permeability that two adjacent dot images formed by ejecting a conventional ink are mixed with each other because the dot images are not dried quickly without penetrating the recording medium, the ink for use in the present invention can stably record clear dot images without causing the dot mixing problem. In this regard, almost all the particles of the colorant included in the ink remain on the surface of the recording medium without penetrating into the recording medium, and therefore the ink has good coloring ability. Namely, the ink can record images having a high image density even in a small amount. As mentioned above, since the amount of carrier fluid included in the ink can be reduced, the ink has a good drying property.

The ink for use in the image recording method of the present invention includes at least water, a particulate colorant, and a surfactant, and optionally includes other components such as fixing agents for fixing the colorant, penetrating agents, and wetting agents.

At first, the particulate colorant will be explained. The color of the particulate colorant is not particularly limited. For example, black, yellow, magenta and cyan color colorants can be used. In addition, the material of the colorants is not particularly limited. Among various colorants, pigments and colored particulate materials can be preferably used.

Specific examples of the colored particulate materials include particulate polymers including a pigment or a dye (such as particulate polymers containing a pigment or a dye therein, and particulate polymers having a surface to which a pigment or a dye is adsorbed). In this regard, all of the colorant is not necessarily contained in the particulate polymers or adsorbed to the surface thereof, and a part of the colorant may be dispersed in the ink by itself as long as the effects of the present invention are produced by the ink. Any known colorants can be used as the colorant as long as the colorants are insoluble or hardly soluble in water and can be adsorbed to particulate polymers. For example, dyes such as water soluble dyes, oil soluble dyes, and disperse dyes; pigments; etc. can be used as the colorant. Among these colorants, oil soluble dyes and disperse dyes are preferably used because of being well contained in particulate polymers or adsorbed to the surface of particulate polymers. In view of light stability of recorded images, pigments are preferably used.

In this regard, "colorants insoluble or hardly soluble in water" mean colorants which can be dissolved in 100 parts by weight of water in an amount of not greater than 10 parts by weight. In addition, the term "dissolved in water" means the state of a colorant in an aqueous liquid such that the aqueous liquid has no precipitated particles or floating particles of the colorant when the liquid is visually observed.

In order that dyes are effectively adsorbed to particulate polymers, it is preferable that the dyes can be dissolved in an organic solvent (such as ketone solvents) at a content of at least 2 g/liter, and more preferably from 20 g/liter to 600 g/liter.

Suitable materials for use as the water soluble dyes include dyes classified into acid dyes, direct dyes, basic dyes, reactive dyes, and food dyes by Color Index. Among these dyes, dyes having good water resistance and light stability are preferably used.

The volume average particle diameter of such particulate polymers including a colorant (i.e., particulate colored polymers) is preferably from 0.01 μm to 0.16 μm when the particle diameter is measured with respect to the colorant particles dispersed in the ink. When the volume average particle diameter is less than 0.01 μm, blurred images tend to be formed because the particles are easily fluidized, and the light stability of recorded images tends to deteriorate. In contrast, when the volume average particle diameter is greater than 0.16 μm, a nozzle clogging problem in that the inkjet nozzle is clogged with the ink tends to be caused, and the ink tends to have poor coloring property.

When pigments are used as the particulate colorant of the ink, self-dispersible pigments can be preferably used without using dispersants, which have at least one kind of hydrophilic group having bond connectivity with pigments directly or with another group therebetween. Among these self-dispersible pigments, ionic self-dispersible pigments are preferably used, and anionic self-dispersible pigments are more preferably used.

Specific examples of the anionic hydrophilic groups to be included in the anionic self-dispersible pigments include —COOM, —$SO_3M$, —$PO_3HM$, —$PO_3M$, —$SO_2NH_2$, —$SO_2NHCOR$, etc., wherein M represents a hydrogen atom, an alkali metal, an ammonium group, or an organic ammonium group, and R represents an alkyl group having 1 to 12 carbon atoms, a phenyl group optionally having a substituent, or a naphthyl group optionally having a substituent. Among these self-dispersible pigments, pigments having a surface, with which —COOM or —$SO_3M$ is bonded, are preferably used.

Specific examples of the alkali metals for use as the group M include lithium, sodium, potassium, etc. Specific examples of the organic ammonium groups for use as the group M include mono- to tri-methyl ammonium groups, mono- to tri-ethyl ammonium groups, and mono- to tri-methanol ammonium groups, etc.

The methods for preparing anionic color pigments are as follows. Specifically, when bonding a group —COONa with a color pigment, (1) methods in which a color pigment is subjected to an oxidation treatment using sodium hypochlorite; (2) methods using a sulfonating treatment; and (3) methods in which a diazonium salt is reacted with a color pigment, can be used.

The volume average particle diameter of such self-dispersible pigments is preferably from 0.01 μm to 0.16 μm when the pigments are dispersed in ink.

When pigments are used as the particulate colorant of the ink, pigment dispersions using a dispersant can also be used. In this regard, hydrophilic polymers such as polymers made of natural materials, semi-synthetic polymers, and synthetic polymers can be used as the dispersant.

Specific examples of the polymers made of natural materials include vegetable-based polymers such as gum acacia, astragalus gummifer gum, Guar Gum, gum karaya, locust bean gum, arabinogalactan, pectin, and pyrus cydonia seed starch; seaweed-based polymers such as alginic acid, carrageenan, and agar; animal-based polymers such as gelatin, albumin, collagen and shellac; and microbial polymers such as xanthene gum, and dextran.

Specific examples of the semi-synthetic polymers include cellulose-based polymers such as methyl cellulose, ethyl cellulose, hydroxyethyl cellulose, hydroxypropyl cellulose, and carboxymethyl cellulose; starch-based polymers such as sodium starch glycolate, and sodium starch phosphate; and seaweed-based polymers such as sodium alginate, and propylene glycol esters of alginic acid.

Specific examples of the synthetic polymers include vinyl polymers such as polyvinyl alcohol, polyvinyl pyrrolidone, and polyvinyl methyl ether; acrylic polymers such as non-crosslinked polyacrylamide, polyacrylic acid, metal salts of polyacrylic acid, and water-soluble styrene-acrylic resins; water-soluble styrene-maleic resins, water-soluble vinylnaphthalene-acrylic resins, water-soluble vinylnaphthalene-maleic resins, alkali metal salts of formaldehyde condensation products of β-naphthalene, polymers having a cationic group such as quaternary ammonium groups and amino groups in a side chain thereof, etc.

Among these polymers, polymers having a carboxyl group such as homopolymers of acrylic acid, and methacrylic acid; copolymers such as styrene-acrylic copolymers; and copolymers thereof having a unit obtained from a monomer having a hydrophilic group can be preferably used as the dispersant.

The weight average molecular weight of the homopolymers and copolymers for use as the dispersant is preferably from 3,000 to 50,000, more preferably from 5,000 to 30,000, and even more preferably from 7,000 to 15,000. The mixing ratio (P/D) of a pigment (P) to a dispersant (D) is preferably from 1/0.06 to 1/3, and more preferably from 1/0.125 to 1/3.

One or more black or colored inorganic or organic pigments can be used as the particulate colorant to be included in the ink for use in the image recording method of the present invention.

Specific examples of the inorganic pigments include titanium oxide, iron oxide, calcium carbonate, barium sulfate, aluminum hydroxide, barium yellow, cadmium red, chrome yellow, and carbon blacks prepared by any known methods such as contact methods, furnace methods, and thermal methods.

Specific examples of the organic pigments include azo pigments (such as azo lakes, insoluble azo pigments, condensed azo pigments, and chelate azo pigments), polycyclic pigments (such as phthalocyanine pigments, perylene pigments, perynone pigments, anthraquinone pigments, quinacridone pigments, dioxazine pigments, indigo pigments, thioindigo pigments, isoindolinone pigments, and quinophthalone pigments), chelate dyes (such as basic dye-based chelates, and acidic dye-based chelates), nitro pigments, nitroso pigments, and aniline black. Among these pigments, pigments having good affinity for water are preferably used.

Specific examples of the black pigments include carbon blacks (C.I. Pigment Black 7) such as furnace black, lamp black, acetylene black, and channel black; metals and metal compounds such as copper, iron (C.I. Pigment Black 11), and titanium oxide; and organic pigments such as aniline black.

Specific examples of the colored pigments include C.I. Pigment Yellows 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 128, 138, 150, 151, 153, and 183; C.I. Pigment Oranges 5, 13, 16, 17, 36, 43, and 51; C.I. Pigment Reds 1, 2, 3, 5, 17, 22, 23, 31, 38, 48:1, 48:2 (PERMANENT RED 2B(Ca)), 48:3, 48:4, 49:1, 52:2, 53:1, 57:1 (Brilliant Carmine 6B), 60:1, 63:1, 63:2, 64:1, 81, 83, 88, 101 (red iron oxide), 104, 105, 106, 108 (cadmium red), 112, 114, 122 (Quinacridone Magenta), 123, 146, 149, 166, 168, 170, 172, 177, 178, 179, 185, 190, 193, 166, 209, and 219; C.I. Pigment Violets 1 (Rhodamine Lake), 3, 5:1, 16, 19, 23, and 38; and C.I. Pigment Greens 1, 4, 7, 8, 10, 17, 18, and 36.

In addition, phthalocyanine pigments are preferably used for cyan colorants. Specific examples thereof include C.I. Pigment Blues 1, 2, 3, 15 (Copper Phthalocyanine Blue R), 15:1, 15:2, 15:3 (Phthalocyanine Blue G), 15:4, 15:6 (Phthalocyanine Blue E), 15:34, 16, 17:1, 22, 56, 60, and 63; and C.I. Vat Blue 4, and 60. Among these cyan colorants, Phthalocyanine Blue G (15:3) is preferably used because of having advantages in costs and safety.

The content of a particulate colorant in the ink is preferably 2 to 15% by weight, and more preferably from 3 to 12% by weight, based on the weight of the ink. When the content is too low, the tinting power of the colorant cannot be well exerted, resulting in decrease of image density, and in addition the viscosity of the ink is decreased, resulting in occurrence of feathering and blurring of images. In contrast, when the content is too high, the nozzle clogging problem in that the inkjet nozzle is clogged with the dried ink in an inkjet recording device when the ink is left for a long period of time without being used occurs. In addition, another problem in that due to increase of the viscosity of the ink, the penetrating ability of the ink deteriorates occurs. In addition, dot images do not spread due to increase of the viscosity, and thereby the image density is decreased or evenness of images deteriorates (i.e., grainy images are formed).

The ink for use in the image recording method of the present invention includes a surfactant. The surfactant is not particularly limited. For example, anionic surfactants, nonionic surfactants, ampholytic surfactants, and fluorine-containing surfactants can be preferably used.

Specific examples of the anionic surfactants include polyoxyethylene alkyl ether acetates, dodecylbenzenesulfonates, lauric acid salts, polyoxyethylene alkyl ether sulfates, etc.

Specific examples of the nonionic surfactants include acetylene glycol-based surfactants, polyoxyethylene alkyl ethers, polyoxyethylene alkylphenyl ethers, fatty acid esters of polyoxyethylene sorbitan, polyoxypropylene polyoxyethylene alkyl ethers, polyoxyethylene alkyl esters, polyoxyethylene alkyl amines, polyoxyethylene alkyl amides, etc.

Specific examples of the acetylene glycol-based surfactants include 2,4,7,9-tetramethyl-5-decyne-4,7-diol, 3,6-dimethyl-4-octyne-3,6-diol, 3,5-dimethyl-1-hexyne-3-ol, etc. Specific examples of the marketed products of such acetylene glycol-based surfactants include SURFYNOL 104, 82, 465, 485 and TG from Air Products and Chemicals, Inc.

Specific examples of the ampholytic surfactants include laurylamino propionic acid salts, lauryldimethyl betaine, stearyldimethyl betaine, layryldihydroxyethyl betaine, etc. More specifically, lauryldimethylamine oxide, myristyldimethylamine oxide, stearyldimethylamine oxide, dihydroxyethyllaurylamine oxide, polyoxyethylene copra oil alkyldimethylamine oxide, dimethylalkyl (copra oil) betaine, dimethyllauryl betaine, etc.

Among these surfactants, surfactants having the following formula (I), (II), (III), (IV), (V) or (VI) are preferably used.

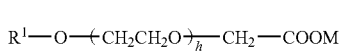

(I)

In formula (I), $R^1$ represents an alkyl group; h is an integer of from 3 to 12; and M represents an alkali metal ion, a quaternary ammonium group, a quaternary phosphonium group, or an alkanol amine group.

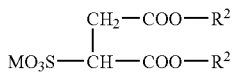

(II)

In formula (II), $R^2$ represents an alkyl group; and M represents an alkali metal ion, a quaternary ammonium group, a Quaternary phosphonium group, or an alkanol amine group.

(III)

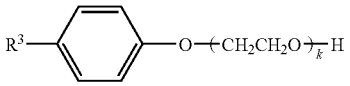

In formula (III), $R^3$ represents a hydrocarbon group; and k is an integer of from 5 to 20.

(IV)

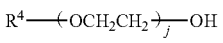

In formula (IV), $R^4$ represents a hydrocarbon group; and j is an integer of from 5 to 20.

(V)

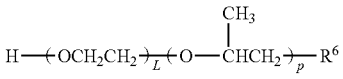

In formula (V), $R^6$ represents a hydrocarbon group; and each of L and p is an integer of from 1 to 20.

(VI)

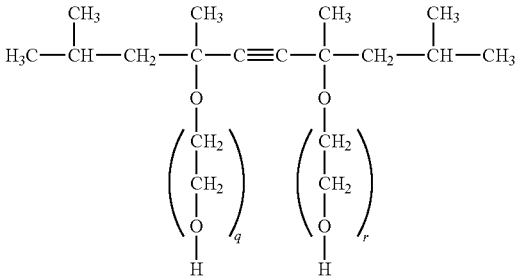

In formula (VI), each of q and r is 0 or an integer of from 1 to 40.

Specific examples of the formulae (I) and (II) are as follows. In this regard, the formulae are described in a free acid form (i.e., M=H).

(I-1)

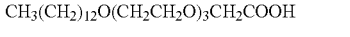

(I-2)

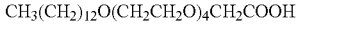

(I-3)

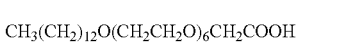

(I-4)

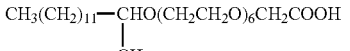

(I-5)

(I-6)

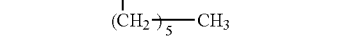

-continued (II-1)

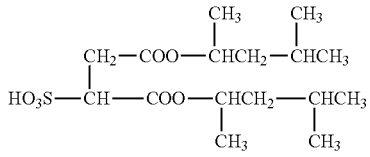

(II-2)

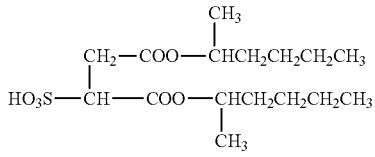

(II-3)

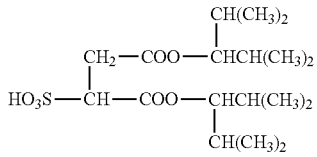

(II-4)

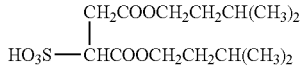

Specific examples of the fluorine-containing surfactants include perfluoroalkylsulfonic acid compounds, perfluoroalkylcarboxylic acid compounds, perfluoroalkylphosphoric acid ester compounds, perfluoroalkylethylene oxide adducts, polyalkyleneether polymer compounds having a perfluoroalkylether group in a side chain thereof, etc. Among these surfactants, polyalkyleneether polymer compounds having a perfluoroalkylether group in a side chain thereof are preferably used because of having advantages of little producing foam, and having high safety (because hardly accumulating in human bodies).

Specific examples of the perfluoroalkylsulfonic acid compounds include perfluoroalkylsulfonic acid, perfluoroalkylsulfonic acid salts, etc. Specific examples of the perfluoroalkylcarboxylic acid compounds include perfluoroalkylcarboxylic acids, perfluoroalkylcarboxylic acid salts, etc. Specific examples of the perfluoroalkylphosphoric acid ester compounds include perfluoroalkylphosphoric acid esters, salts of perfluoroalkylphosphoric acid esters, etc. Specific examples of the polyalkyleneether polymer compounds having a perfluoroalkylether group in a side chain thereof include polyalkyleneether polymers having a perfluoroalkylether group in a side chain thereof, salts of sulfuric acid esters of polyalkyleneether polymers having a perfluoroalkylether group in a side chain thereof, salts of polyalkyleneether polymers having a perfluoroalkylether group in a side chain thereof, etc.

Specific examples of the counter ions of these fluorine-containing surfactants include Li ion, Na ion, K ion, $NH_4$ ion, $NH_3CH_2CH_2OH$ ion, $NH_2(CH_2CH_2OH)_2$ ion, $NH(CH_2CH_2OH)_3$ ion, etc.

As for the fluorine-containing surfactants, both of synthesized fluorine-containing surfactants and marketed fluorine-containing surfactants can be used. Among the fluorine-containing surfactants, surfactants having the following formula (VII) are preferably used.

$$CF_3CF_2(CF_2CF_2)_m—CH_2CH_2O(CH_2CH_2O)_nH \quad (VII)$$

In formula (VII), m is 0 or an integer of from 1 to 10; and n is an integer of from 1 to 40.

Specific examples of the marketed fluorine-containing surfactants include SARFRON S-111, S-112, S-113, S-121, S-131, S-132, S-141, and S-145 (from Asahi Glass Co., Ltd.); FLUORAD FC-93, FC-95, FC-98, FC-129, FC-135, FC-170C, FC-430, and FC-431 (from Sumitomo 3M Limited); MEGAFACE F-470, F1405, and F-474 (from DIC Corporation); ZONYL TBS, FSP, FSA, FSN-100, FSN, FSO-100, FSO, FS-300, and UR (from E.I. du Pont de Nemours and Company); FT-110, FT-250, FT-251, FT-400S, FT-150, and FT-400SW (from Neos Co., Ltd.); PF-151N (from Omnova Solutions, Inc.); etc. Among these surfactants, ZONYL FS-300, FSN, FSN-100, and FSO (from E.I. du Pont de Nemours and Company) are preferably used.

As mentioned above, the ink for use in the image recording method of the present invention optionally includes a penetrating agent. In this application, the penetrating agent is defined as an organic solvent, which performs a function of accelerating penetration of the ink into papers relatively well among organic solvents. In contrast, the wetting agent is defined as an organic solvent, which has a wetting function, i.e., a function of preventing the ink in an inkjet head from drying.

Suitable materials for use as the penetrating agent include polyol compounds and glycol ether compounds, which are soluble in water and which have not less than 8 carbon atoms, and preferably from 8 to 11 carbon atoms.

When the carbon number is less than 8, the polyol compounds have insufficient penetrating ability. In this case, problems which occur are that the backside of prints is soiled with other ink images, resulting in deterioration of image qualities of double-side prints; and dot images do not well spread on a recording medium, resulting in deterioration of evenness (pixel-filling property) of character images and decrease of image density.

Specific examples of the polyol compounds having not less than 8 carbon atoms include 2-ethyl-1,3-hexanediol, which has water solubility of 4.2% at 25° C., 2,2,4-trimethyl-1,3-pentanediol, which has water solubility of 2.0% at 25° C., etc.

The added amount of a penetrating agent is not particularly limited, and is determined depending on the applications of the ink. The added amount is preferably from 0.1 to 20% by weight, and more preferably from 0.5 to 10% by weight.

Next, the wetting agent optionally included in the ink will be explained.

The wetting agent is not particularly limited, and is selected from any known wetting agents depending on the applications of the ink. Suitable compounds for use as the wetting agent include polyol compounds, nitrogen-containing heterocyclic compounds, amides, amines, sulfur-containing compounds, propylene carbonate, ethylene carbonate, urea compounds, and saccharide. These compounds can be used alone or in combination.

Specific examples of the polyol compounds include polyhydric alcohols, alkyl ethers of polyhydric alcohols, aryl ethers of polyhydric alcohols, etc. These compounds can be used alone or in combination.

Specific examples of the polyhydric alcohols include ethylene glycol, diethylene glycol, triethylene glycol, polyethylene glycol, polypropylene glycol, 1,3-propanediol, 1,3-butanediol, 1,4-butanediol, 3-methyl-1,3-butanediol, 1,5-pentanediol, 1,6-hexanediol, glycerol, 1,2,6-hexanetriol, 1,2,4-butanetriol, 1,2,3-butanetriol, petriol, etc.

Specific examples of the alkyl ethers of polyhydric alcohols include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, propylene glycol monoethyl ether, etc.

Specific examples of the aryl ethers of polyhydric alcohols include ethylene glycol monophenyl ether, ethylene glycol monobenzyl ether, etc.

Specific examples of the nitrogen-containing heterocyclic compounds include N-methyl-2-pyrrolidone, N-hydroxyethyl-2-pyrrolidone, 2-pyrrolidone, 1,3-dimethylimidazolidinone, ϵ-caprolactam, etc.

Specific examples of the amide compounds include formamide, N-methylformamide, N,N-dimethylformamide, etc.

Specific examples of the amine compounds include monoethanolamine, diethanolamine, triethanol amine, monoethyl amine, diethyl amine, triethyl amine, etc.

Specific examples of the sulfur-containing compounds include dimethylsulfoxide, sulfolane, thiodiethanol, etc.

Specific examples of the urea compounds include urea, thiourea, ethylene urea, 1,3-dimethyl-2-imidazolidinone, etc. The added amount of a urea compound in the ink is preferably from 0.5 to 50% by weight, and more preferably from 1 to 20% by weight.

As for the saccharide, monosaccharide, disaccharide, oligosaccharide (including trisaccharide and tetrasaccharide), polysaccharide, derivatives of these saccharides, etc., can be used. Among these compounds, glucose, mannose, fructose, ribose, xylose, arabinose, galactose, maltose, cellobiose, lactose, sucrose, trehalose, and maltotriose are preferably used, and multitose, sorbitose, gluconolactone, and maltose are more preferably used. The above-mentioned polysaccharide is interpreted as saccharide in a broad sense, and is interpreted to include natural materials such as α-cyclodextrin, and cellulose.

Specific examples of the derivatives of saccharide include reduction sugar of the saccharide (e.g., sugar alcohol having formula, $HOCH_2(CHOH)_nCH_2OH$ (n is an integer of from 2 to 5), oxidation sugar of the saccharide (e.g., aldonic acid and uronic acid), amino acid, thioacid, etc. Among these compounds, sugar alcohols such as multitol and sorbit are preferably used.

Among the above-mentioned wetting agents, the below-mentioned compounds are preferably used for the ink for use in the image recording method of the present invention because of having good water solubility and preventing occurrence of a problem in that the ejecting property of the ink deteriorates due to evaporation of water.

Glycerin, ethylene glycol, diethylene glycol, triethylene glycol, propylene glycol, dipropylene glycol, tripropylene glycol, 1,3-butanediol, 2,3-butanediol, 1,4-butanediol, 3-methyl-1,3-butanediol, 1,3-propanediol, 1,5-pentanediol, tetraethylene glycol, 1,6-hexanediol, 2-methyl-2,4-pentanediol, polyethylene glycol, 1,2,4-butanetriol, 1,2,6-hexanetriol, thiodiglycol, 2-pyrrolidone, N-methyl-2-pyrrolidone, N-hydroxyethyl-2-pyrrolidone, etc.

The content of a wetting agent in the ink is preferably from 10 to 50% by weight, and more preferably from 20 to 35% by weight. When the content is too low, the ink in the nozzle tends to be easily dried, resulting in occurrence of the nozzle clogging problem in that the ink is not ejected from the nozzle. In contrast, when the content is too high, the viscosity of the ink seriously increases, resulting in defective ink ejection.

The ink for use in the image recording method of the present invention can include a resin emulsion as a fixing agent. The resin emulsion is such that a particulate resin is dispersed in water, which serves as a disperse medium and forms a continuous phase. The resin emulsion can optionally include a dispersant such as surfactants. The content of a particulate resin (forming a disperse phase) in the resin emulsion is generally from 10 to 70% by weight. The average particle diameter of resin particles in the resin emulsion is preferably from 10 nm to 1000 nm, and more preferably from 20 nm to 300 nm.

The composition of the resin dispersed in the resin emulsion is not particularly limited, and any known resins, which can form emulsions, can be used therefor. Specific examples of the resin include acrylic resins, vinyl acetate resins, styrene resins, butadiene resins, styrene-butadiene resins, vinyl chloride resins, acrylic styrene resins, acrylic silicone resins, etc. Among these resins, acrylic silicone resins are preferably used.

Synthesized resin emulsions and marketed resin emulsions can be used as the resin emulsion. Specific examples of the marketed resin emulsions include MICROGEL E-1002 and E-5002 (styrene-acrylic resin emulsions from Nippon Paint Co., Ltd.); VONCOAT 4001 (acrylic resin emulsion) and 5454 (styrene-acrylic resin emulsion), which are from DIC Corporation); SAE-1014 (styrene-acrylic resin emulsion from Nippon Zeon Co., Ltd.); SAIBINOL SK-200 (acrylic resin emulsion from Saiden Chemical Industry Co., Ltd.); PRIMAL AC-22 and AC-61 (acrylic resin emulsion from Rohm & Haas Co.); NANOCRYL SBCX-2821 and 3689 (acrylic silicone resin emulsion from Toyo Ink Mfg. Co., Ltd.); #3070 (polymethyl methacrylate emulsion from Mikuni Color Ltd.); etc.

The added amount of a resin emulsion is preferably controlled such that the particulate resin included in the emulsion is present in an amount of from 0.1 to 50% by weight, preferably from 0.5 to 20% by weight, and more preferably from 1 to 10% by weight, based on the total weight of the ink. When the added amount is too small, a good combination of nozzle-clogging resistance and ink ejection stability cannot be imparted to the ink. When the added amount is too large, the ink preservability deteriorates.

The ink for use in the image recording method of the present invention can optionally include other components such as pH controlling agents, antiseptic agents, rust preventing agents, antioxidants, ultraviolet absorbents, oxygen absorbents, and light stabilizers.

Suitable materials for use as the pH controlling agents include compounds, which can control the pH of the ink so as to be not lower than 7 and which do not adversely affect the qualities of the ink. Specific examples thereof include amines such as diethanolamine and triethanolamine; hydroxides of alkali metals such as lithium hydroxide, sodium hydroxide, and potassium hydroxide; ammonium hydroxide, quaternary ammonium hydroxide, quaternary phosphonium hydroxide, carbonates of alkali metals such as lithium carbonate, sodium carbonate, and potassium carbonate; etc.

Next, the method for preparing the ink will be explained.

Specifically, the essential ink components such as particulate colorants and surfactants, and optional ink components such as penetrating agents, wetting agents, resin emulsions, pH controlling agents, antiseptic agents, rust preventing agents, antioxidants, ultraviolet absorbents, oxygen absorbents, and light stabilizers are dispersed or dissolved in an aqueous medium including water, followed by optional filtering. The resultant dispersion may be diluted with an aqueous medium such as water while agitated to control the solid content and properties (such as viscosity) of the ink. In addition, resultant dispersion may be mixed with optional additives followed by agitating.

The dispersing treatment is typically performed using a dispersing device such as sand mills, homogenizers, ball mills, paint shakers, and ultrasonic dispersing devices. The agitation is typically performed using an agitator such as agitators having an agitating blade, magnetic stirrers, and high speed dispersing devices.

The solid content of the ink is preferably not lower than 6% by weight. When the solid content is too low, the viscosity of droplets of the ink (i.e., ink image) on the surface of a recording medium gradually increases in the drying process (namely, the drying speed of droplets of the ink is slow), and thereby the recorded image is blurred. The solid content is preferably as high as possible. However, when the solid content is too high, the nozzle clogging problem tends to be caused. Therefore, the solid content is preferably not higher than 15% by weight.

The ink for use in the present invention preferably has a high penetrating ability. As a result of investigation of the present inventors, it is found that the surface tension of the ink is preferably not greater than 30 mN/m. When the surface tension is greater than 30 mN/m, the penetration speed of the ink is too slow, and thereby the recorded image tends to be blurred, resulting in deterioration of image qualities. As the surface tension decreases, the solvent included in ink droplets (i.e., dot images) on a recording medium can be separated more easily from the pigment in the image, and thereby the recorded image can be quickly dried. However, when the surface tension is too low, the nozzle plate is excessively wetted by the ink, and thereby ink droplets cannot be well formed (i.e., ink droplets cannot be stably formed), resulting in formation of images having poor image qualities. In addition, blurred images are formed. Therefore, the surface tension of the ink is preferably from 15 mN/m to 30 mN/m, and more preferably from 15 mN/m to 25 mN/m.

The surface tension of the ink can be adjusted by changing the added amount of a wetting agent (such as ethylhexanediol (EHD)) or a fluorine-containing surfactant (such as FS300 from DuPont). In this application, the surface tension of ink is measured at 25° C. using a surface tension meter CBVP-Z from Kyowa Interface Science Co., Ltd. and a platinum plate.

The ink for use in the image recording method of the present invention can also be used for conventional void-structure type inkjet recording media. In this case, since the ink has too high a penetrating speed, the solvent included in ink droplets (i.e., dot images) on the surface of a recording medium quickly penetrates into the recording medium. Therefore, the diameter of dot images becomes smaller than the desired diameter. Accordingly, the recorded image has a low image density and poor evenness because a granular image is formed. In this regard, when the scanline density is increased to improve the image density and evenness of image (i.e., to record high quality images), other problems in that the recording speed decreases and ink consumption increases occur. In addition, when the ink is used for an inkjet recording medium, which has high ink absorption property, ink droplets are quickly absorbed by the recording medium, and thereby an extremely projected image is formed. Therefore, even when the image is subjected to a glossing treatment, the glossiness of the resultant image cannot be sufficiently increased.

The ink for use in the present invention preferably has a viscosity of from 3 mPa·s (cps) to 30 mPa·s, and more preferably from 5 mPa·s to 20 mPa·s at 25° C. When the viscosity is too high, the ejection stability of the ink tends to deteriorate.

The pH of the ink is preferably from 7 to 10.

Next, the glossiness imparting liquid for use in the glossing treatment will be explained.

OP varnishes for use in commercial printing can be preferably used for the glossiness imparting liquid. OP varnishes are broadly classified into oil-based varnishes, aqueous varnishes, and UV varnishes, and all of these varnishes can be used for the glossiness imparting liquid. However, since the substrate of the recording medium for use in the image recording method of the present invention is made from pulp (i.e., cellulose), the recording medium tends to be wrinkled when the glossing treatment is performed using an aqueous varnish. In addition, aqueous varnishes are incompatible with the images recorded by the ink mentioned above. Therefore, it is not preferable to use aqueous varnishes for the glossiness imparting liquid. Oil-based varnishes can produce a glossy layer but have a disadvantage of having low drying speed, and thereby the on-demand printing characteristic of inkjet printing cannot be well exhibited. In contrast, UV varnishes have advantages of having a high drying speed and forming a layer having a relatively high glossiness. Therefore, it is preferable to use UV varnishes for the glossiness imparting liquid.

Conventional UV varnishes used for commercial printing can be used for the glossiness imparting liquid. Specific examples of such UV varnishes include DAICURE CLEAR UV series and DAICURE CLEAR UV1412 (from DIC Corporation); No. 2 UV L CARTON OP VARNISH NM, No. 6 UV L CARTON OP VARNISH GW, No. 6 UV L CARTON OP VARNISH GW-L, UV L CARTON OP VARNISH KS, UV 161 OP VARNISH S, UV L GLOSS OP VARNISH M, UV KIKKOMAN VARNISH K-2, UV RELEASE OP VARNISH Series, UV HJK PROOF PRINTING VARNISH, UV DRY PACK OP VARNISH NK, UV PACK OP VARNISH NS, UV PACK OP VARNISH SK-T, No. 3 UV WET PACK MATTE OP VARNISH L, UV VIDEO OP VARNISH Y, UV GLOSS OP VARNISH CP-3, UV GLOSS OP VARNISH T-100 Series, UV LTP FL OP VARNISH, UV COATING VARNISH AT-B, UV COATING VARNISH AT-SL, UV COATING VARNISH BL-W, UV COATING VARNISH FJ, UV COATING VARNISH HTA-W, UV COATING VARNISH OMT, UV COATING VARNISH TG-2, UV COATING VARNISH TH-3, UV COATING VARNISH TH-S, UV VECTA COATING VARNISH PC-3KW2, No. 2 UV FLEXO VARNISH FT-P, and UV FLEXO VARNISH FV-2 (from T&K Toka Company); FD PCA 800 VARNISH Series, FD PCA 902 VARNISH, FD CLEAR COAT SPC, FD S MULTICOLOR OP VARNISH TK, FD OLP MULTICOLOR OP VARNISH M1, FD CARTON ACE OP VARNISH, FD O WET OP VARNISH K1, and FD CARTON ACE MATTE OP VARNISH (from Toyo Ink Mfg. Co., Ltd.); UV FIL-383 CLEAR and UV FIL393 (from Teikoku Printing Inks Mfg. Co., Ltd.); etc.

In addition, depending on the applications of the recorded images, photo-reactive compositions including a UV crosslinkable resin or monomer and other optional components (such as initiators) can also be used for the glossiness imparting liquid. Specific examples thereof include the following composition.

| | |
|---|---|
| UV crosslinkable resin: Polyurethane acrylate (UNIDIC 17-806 from DIC Corporation) | 100 parts by weight |
| Photoinitiator: 1-hydroxycyclohexyl phenyl ketone (IRGACURE 184 from Ciba Japan K.K.) | 4 parts by weight |
| Diluent: Butyl acetate | 150 parts by weight |

In addition, depending on the applications of the recorded images, oil-based OP varnishes can be used for the glossiness imparting liquid. Specific examples of such oil-based OP varnishes include BEST DRY OP VARNISH N, BEST DRY OP VARNISH 3W, BEST DRY OP VARNISH NW, No. 2 BEST DRY OP VARNISH N-ON, No. 10 OP VARNISH, BEST DRY No. 2 RUB RESISTANT OP VARNISH, BEST DRY ROUGH GLOSS OP VARNISH, OIL-BASED RELEASE OP VARNISH, OP VARNISH SRS (for soaps), ALPO OP VARNISH N, and ALPO RUB RESISTANT OP VARNISH (from T&K Toka Company); MONOCHROME PRINTING-USE OP VARNISH, TK HIGHECHO SOY OP VARNISH 1M, TK HIGHECHO SOY RUB RESISTANT OP VARNISH, MULTICOLOR PRINTING-USE OP VARNISH, TK WET GLOSS OP VARNISH, NEW CKU RUB RESISTANT OP VARNISH A, CKU T OP VARNISH K2, and TK HIGHECHO SOY OP VARNISH 1L (from Toyo Ink Mfg. Co., Ltd.); etc.

Further, resins can be optionally added to the glossiness imparting liquid.

When the viscosity of the varnish used for the glossiness imparting liquid is too low, a large amount of the varnish penetrates into a recording medium. Therefore, varnishes having a high viscosity are preferably used. When the glossiness imparting liquid is applied using an inkjet method, the viscosity of the glossiness imparting liquid (varnish) is preferably not lower than 10 mPa·s. When the viscosity is lower than 10 mPa·s, problems in that the varnish seriously penetrates into a recording medium, resulting in decrease of the glossiness; and the varnish is repelled by the surface of the recording medium, resulting in formation of an uneven glossy image tend to be caused.

Next, the recording medium for use in the image recording method of the present invention will be explained.

Whether a recording medium can be used for the image recording method of the present invention can be determined by measuring the amount of ink absorbed by the medium using a dynamic scanning absorptometer. Specifically, it is preferable for the image recording method of the present invention to use recording media absorbing ink in an amount of from 1 ml/m$^2$ to 10 lml/m$^2$ when measured with a scanning absorptometer at a contact time of 500 ms. Recording media fulfilling this requirement can produce the effect of the present invention when being used in combination with the ink mentioned above. Specifically, in this case, clear and high optical density images can be produced without forming defective images such as blurring, feathering and bleeding.

In addition, when the amount of ink absorbed by the recording medium (hereinafter sometimes referred to as ink absorption amount) is from 5 ml/m$^2$ to 7 ml/m$^2$, the optical density and blurring of recorded images can be improved at the same time. In this case, the surface of recorded images is properly projected. Therefore, by controlling the coating amount of the glossiness imparting liquid (OP varnish), the glossiness of the images can be properly adjusted so as to be the desired glossiness.

When the ink absorption amount of the recording medium is less than 1 ml/m$^2$, a beading problem in that adjacent dots are adhered to each other, resulting in deterioration of image qualities tends to be caused, and it becomes impossible to perform high speed inkjet recording. In contrast, when the ink absorption amount of the medium is greater than 10 ml/m$^2$, the glossiness imparting liquid (OP varnish) tends to excessively penetrate into the recording medium, resulting in formation of images with low glossiness or uneven glossiness. In addition, it becomes impossible to perform thereon an after-treatment such as laminating, and foil stamping, which is typically performed in commercial printing.

The reason why the measurements are performed at the contact time of 500 ms is that the ink is absorbed almost completely by a recording medium (i.e., ink absorption by a recording medium is saturated) at that time.

The recording medium for use in the present invention has thereon a coating layer including a pigment and a binder resin. By increasing the content of a binder resin in the coating liquid, the ink absorption amount of the recording medium can be decreased. In contrast, by increasing the content of a pigment in the coating liquid, the ink absorption amount of the recording medium can be increased. In addition, by increasing the specific surface area of the pigment included in the coating liquid (for example, by decreasing the particle diameter of the pigment), the ink absorption amount of the recording medium can also be increased.

When the ink absorption amount at the contact time of 500 ms is too small, the ink cannot be dried quickly, thereby causing problems such that the recorded image is damaged by a spur-shaped feeding roller of an inkjet recording device, and the ink adhered to the spur-shaped feeding roller is re-transferred to the image, resulting in deterioration of image qualities. In contrast, when the ink absorption amount is too large, bleeding of image tends to be caused, resulting in decrease of the glossiness of the image portion.

In this application, the ink absorption amount is measured with a dynamic scanning absorptometer (DSA), which is introduced by Shigenori KUGA in JAPAN TAPPI JOURNAL Vol. 48 (May 1994) pp 88-92. The dynamic scanning absorptometer can accurately measure the ink absorption amount in a short time. The feature of the dynamic scanning absorptometer is as follows:

(1) The ink absorbing speed of a recording medium is determined from the movement of the meniscus of the ink in a capillary of an ink supplying head; and (2) The surface of a recording medium having a disc form is spirally scanned with the ink supplying head while automatically changing the scanning speed in a predetermined pattern to determine the amount of the ink absorbed by the recording medium.

Thus, the ink absorption amount of a recording medium can be automatically measured with the dynamic scanning absorptometer. In this regard, the ink supplying head is connected with the capillary via a TEFLON tube, and the position of the meniscus of the ink in the capillary is automatically determined by an optical sensor. In this application, the ink absorption amount is measured with a dynamic scanning absorptometer K350 TYPE D from Kyowa Seiko Co., Ltd. The ink absorption amount at the contact time of 500 ms can be determined by an interpolation method from the ink absorption amount data at contact times near 500 ms. The measurements are performed at 23° C. and 50% RH.

Next, the substrate of the recording medium for use in the image recording method of the present invention will be explained.

The substrate of the recording medium is made from pulp (cellulose). Specifically, pulps in which chemical pulp (CP), mechanical pulp (MP) and pulp obtained from used paper are mixed in any ratio, are used. Such pulps are mixed with optional additives such as internal sizing agents, yield increasing agents, and paper strength improving agents, and a paper is made from the thus prepared pulp mixture (raw material) using a paper machine having a long wire mesh former (fourdrinier), a gap-type twin wire former, a hybrid former in which the later part of a long wire mesh portion is formed of a twin wire, or the like.

Specific examples of the pulps for use in the substrate of the recording medium include virgin chemical pulps, which are prepared by subjecting a fiber source material such as wood to a chemical treatment, such as L-Bleached Kraft Pulp, N-Bleached Kraft Pulp, L-Unbleached Kraft Pulp, N-Unbleached Kraft Pulp, L-Bleached Sulfite Pulp, N-Bleached Sulfite Pulp, L-Unbleached Sulfite Pulp, and N-Unbleached Sulfite Pulp. In this regard, virgin mechanical pulps, which are prepared by subjecting a fiber source material such as wood to a mechanical treatment, such as ground pulps, chemi-ground pulps, chemi-mechanical pulps, and semi-chemical pulps, can be added to the chemical pulps.

In addition, pulps made from used paper (hereinafter referred to as recycled pulps) can also be used for the substrate. Used papers listed in a quality specification table in a web-page of Paper Recycling Promotion Center (Japan) can be used as raw materials for the recycled pulps. Specific examples of the used papers include high quality white papers without print images, high quality white papers with line prints, cream-color white cards, medium quality white papers without print images, woody papers without print images, high quality white papers with black images, high quality white papers and art papers with color prints, high quality white cut papers and art papers with color prints, white art papers without print images, newspapers, magazines, etc. More specifically, used papers for printers such as non-coated computer papers, thermal papers, and pressure-sensitive papers; papers used in office automation fields such as papers for plain paper copiers; used coated papers such as art papers, coated papers, ultra light coated papers, and matte papers; used non-coated papers such as high-quality papers, colored high-quality papers, note papers, letter papers, wrapping papers, fancy papers, medium-quality papers, papers for newspaper, woody papers, super-calendered papers, simili papers, pure white roll papers, and milk carton papers; and used paperboards, can be used. These papers can be used alone or in combination.

Used paper pulps can be prepared by a method including the following four processes.

(1) In a defibration process, used papers are treated with a pulper using chemicals and mechanical force to separate fibers from each other while separating print inks from the fibers;

(2) In a dust removal process, foreign materials such as plastics and dusts included in the used papers are removed therefrom using a screen or a cleaner;

(3) In a deinking process, print inks, which have been released from cellulose fibers using a surfactant, are removed from the system using a flotation method or a washing method; and (4) In a bleaching process, the thus obtained cellulose fibers are subjected to an oxidation or reduction treatment to enhance the whiteness thereof.

When used paper pulps are used for the substrate, the content of the used paper pulps in the entire pulps is preferably not greater than 40% by weight in view of curling of the recording medium after recording.

The substrate of the recording medium can include a filler such as white inorganic fillers, e.g., light calcium carbonate, ground calcium carbonate, kaolin, clay, talc, calcium sulfate, barium sulfate, titanium oxide, zinc oxide, zinc sulfide, zinc carbonate, satin white, aluminum silicate, diatom earth, calcium silicate, magnesium silicate, synthesized silica, aluminum hydroxide, alumina, lithopone, zeolite, magnesium carbonate, magnesium hydroxide, pyrophyllite, sericite; and organic fillers, e.g., styrene-based plastic pigments, acrylic-based plastic pigments, urea resin pigments, and melamine resin pigments. These fillers can be used alone or in combination.

The internal sizing agent used for the substrate of the recording medium is not particularly limited, and it is possible to use a proper sizing agent selected from any known sizing agents for use in conventional inkjet recording papers and printing papers. For example, rosin emulsion type sizing agents can be used. Among such sizing agents, neutral rosin sizing agents, alkenylsuccinic anhydride (ASA), alkyl ketene dimer (AKD), and petroleum resin type sizing agents are preferably used because the pH of the substrate can be increased, and neutral rosin sizing agents, and alkenylsuccinic anhydride are more preferably used. The added amount of an internal sizing agent is preferably from 0.1 to 0.7 parts by weight based on 100 parts by weight of dry pulp.

The recording medium for use in the image recording method of the present invention has a coating layer thereon, which includes a pigment and a binder resin, and optionally includes other components such as surfactants. Suitable materials for use as the pigment include inorganic pigments and combinations of an inorganic pigment and an organic pigment.

Specific examples of the inorganic pigments include kaolin, talc, light calcium carbonate, ground calcium carbonate, calcium sulfite, amorphous silica, titan white, magnesium carbonate, titanium dioxide, aluminum hydroxide, calcium hydroxide, magnesium hydroxide, zinc hydroxide, chlorite, illite, and clay. Among these pigments, pigments having a relatively high refraction index are preferably used because the coating layer can be thinned. In view of costs, calcium carbonate and kaolin are preferably used. Particularly, kaolin is preferable because of increasing the glossiness of the coating layer such that the appearance of the recording medium is almost the same as that of offset printing papers. These pigments can be used alone or in combination. In addition, these pigments can be used in combination with other pigments not listed above.

Kaolin is broadly classified into delaminated kaolin, calcined kaolin, and engineered kaolin, which is subjected to surface modification. In order that the coated layer has high glossiness, it is preferable that a kaolin including small particles having a particle diameter of not greater than 2 μm in an amount of not less than 80% by weight is included in the total weight of kaolins used for the coating layer. It is preferable that kaolin is included in an amount of not less than 50 parts by weight based on 100 parts by weight of the pigments included in the coating layer. When the added amount is too small, there is a case where the resultant coating layer cannot have a desired glossiness. The upper limit of the added amount of kaolin is not particularly limited. However, when the added amount of kaolin is too high, the fluidity of the coating liquid deteriorates, i.e., the viscosity thereof seriously increases under a high shearing force. From this point of view (i.e., coating property), the added amount of kaolin is preferably not greater than 90 parts by weight based on 100 parts by weight of the pigments included in the coating layer.

It is also preferable to use a combination of a pigment having a high refraction index and a pigment having a low refraction index such as silica and organic pigments. Specific examples of such organic pigments include aqueous dispersions of resins such as styrene-acrylic copolymers, styrene-butadiene copolymers, polystyrene, and polyethylene. The organic pigments can be used alone or in combination. The added amount of such an organic pigment is preferably from 2 to 20 parts by weight based on 100 parts by weight of the pigments included in the coating layer. Since organic pigments have advantages of having good glossiness imparting property and relatively low specific gravity, a coating layer, which is bulky and highly glossy and has good covering property, can be formed. When the added amount of an organic pigment is smaller than 2 parts by weight, the above-mentioned effects cannot be well produced. In contrast, when the added amount is larger than 20 parts by weight, the fluidity of the coating liquid deteriorates, resulting in deterioration of the productivity of the coating layer and increase of manufacturing costs.

The organic pigments are broadly classified into dense (i.e., solid) pigments, hollow pigments and donut-form pigments with respect to the particle form. In order to balance the glossiness imparting property, covering property and fluidity, hollow organic pigments are preferably used. More preferably, hollow organic pigments having an average particle diameter of from 0.2 μm to 3.0 μm, and a hollow ratio of not lower than 40% are preferably used.

The binder resin included in the coating layer is not particularly limited as long as the resin has good blocking resistance and good adhesiveness with the pigment included in the coating layer and the substrate of the recording medium, on which the coating layer is formed, and can be dissolved or dispersed (emulsified) in water.

Specific examples of such water-soluble or dispersible resins include polyvinyl alcohol, starches (such as oxidized starch, esterified starch, starch modified with enzyme, and cationic starch), casein, soybean protein, cellulose derivatives (such as carboxymethyl cellulose, and hydroxyethyl cellulose), styrene-acrylic resins, isobutylene-maleic anhydride resins, acrylic emulsions, ethyl acetate emulsions, vinylidene chloride emulsions, polyester emulsions, styrene-butadiene rubber (SBR) latexes, acrylonitrile-butadiene rubber latexes, etc. Among these materials, starches and SBR latexes are preferably used in view of costs.

In this regard, SBR latexes are defined as synthesized rubber latexes, which are prepared by subjecting styrene monomer and butadiene monomer to an emulsion polymerization together with optional monomers and in which a styrene-butadiene copolymer forms a discontinuous phase in water. SBR latexes are typically used for coating liquids for forming cast coated papers. A coating layer prepared by a coating liquid including such a SBR latex has a hydrophobic property. In this case, the wettability of an aqueous ink against such a coating layer deteriorates. In addition, such a coating layer has poor affinity for a cationic agent included in inkjet inks as a fixing agent, and therefore SBR latexes are not used for inkjet recording media. However, SBR latexes are preferably used for improving offset printing properties of recording media.

Specific examples of the optional monomers for use in preparing the water-soluble or dispersible resins include vinyl monomers such as acrylic acid, methacrylic acid, alkyl esters of acrylic acid and methacrylic acid, acrylonitrile, maleic acid, fumaric acid, and vinyl acetate. In addition, crosslinking agents such as methylol melamine, methylol urea, methylol hydroxypropylene urea, and isocyanate can be used for forming the coating layer. Alternatively, copolymers, which have a self-crosslinking ability because of having a unit obtained from a monomer such as N-methylol acrylamide, can be used instead of such crosslinking agents. These monomers and crosslinking agents are used alone or in combination.

In the styrene-butadiene copolymers constituting SBR latexes, the content of the units obtained from styrene monomer is preferably from 20 to 80% by weight, and the content of the units obtained from butadiene monomer is preferably from 80 to 20% by weight.

The content of a binder resin in the coating layer is preferably from 50 to 70% by weight, and more preferably from 55 to 60% by weight, based on the total weight of solid components included in the coating layer. When the content is too low, the coating layer (i.e., ink receiving layer) has poor adhesiveness to the substrate, resulting in deterioration of mechanical strength and internal binding strength of the ink receiving layer, thereby causing a problem in that the layer is peeled from the substrate.

The coating liquid for the coating layer can optionally include other components in such amounts that the effects of the present invention are not curbed. Specific examples of such optional components include additives used for coated papers such as dispersants, viscosity increasing agents, water holding agents, defoaming agents, and water resistance improving agents; and other additives such as pH controlling agents, antiseptics, antioxidants, alumina powders, and cationic organic compounds.

The surfactant used for the coating liquid is not particularly limited, and proper surfactants selected from anionic surfactants, cationic surfactants, ampholytic surfactants, and nonionic surfactants are used in consideration of the applications of the recording medium (i.e., print image). Among these surfactants, nonionic surfactants are preferably used. By using such surfactants, the water resistance and image density of the recorded images are improved while formation of bleeding of image is prevented.

Suitable nonionic surfactants for use in the coating liquid include ethylene oxide adducts of higher alcohols, ethylene oxide adducts of alkylphenols, ethylene oxide adducts of fatty acids, ethylene oxide adducts of fatty acid esters of higher alcohols, ethylene oxide adducts of higher aliphatic amines, ethylene oxide adducts of fatty acid amides, ethylene oxide adducts of oils and fats, ethylene oxide adducts of polypropylene glycol, fatty acid esters of glycerol, fatty acid esters of pentaerythritol, fatty acid esters of sorbitol and sorbitan, fatty acid esters of sucrose, alkyl ethers of polyalcohols, fatty acid amides of alkanol amines, etc. These surfactants can be used alone or in combination.

The polyalcohols for use in preparing the above-mentioned surfactants are not particularly limited. Specific examples thereof include glycerol, trimethylol propane, pentaerythritol, sorbitol, sucrose, etc. In addition, ethylene oxide adducts mentioned above for use as the surfactants can be partially substituted with propylene oxide and/or butylene oxide as long as the resultant adducts can be dissolved in water. In this regard, the substitution ratio is preferably not greater than 50%.

The nonionic surfactants used for the coating liquid for forming the coating layer preferably have a HLB (hydrophile-lipophile balance) of from 4 to 15, and more preferably from 7 to 13. The added amount of a surfactant in the coating liquid is from 0 to 10 parts by weight, and preferably from 0.1 to 1.0 part by weight, based on 100 parts by weight of the cationic organic compounds included in the coating layer.

Cationic organic compounds are not necessarily included in the coating layer. When a large amount of cationic organic compound is included, the pH of the surface of the recording medium is decreased. Therefore, it is preferable to use a proper amount of cationic organic compound in consideration of the applications of the print image.

Specific examples of cationic organic compounds include dimethylamine/epichlorohydrin polycondensation products, dimethylamine/ammonia/epichlorohydrin polycondensation products, poly(trimethylaminoethyl methacrylate/methylsulfuric acid salt), diarylamine hydrochloride/acrylamide copolymers, poly (diarylamine hydrochloride/sulfur dioxide), polyarylamine hydrochloride, poly(arylamine hydrochloride/diarylamine hydrochloride), acrylamide/diarylamine copolymers, polyvinylamine copolymers, dicyandiamide, dicyandiamide/ammonium chloride/urea/formaldehyde condensation products, polyalkylenepolyamine/dicyandiamide ammonium salt condensation products, poly(diaryldimethylammonium chloride), poly (diaryldimethylammonium chloride/sulfur dioxide), poly (diaryldimethylammonium chloride/diarylamine hydrochloride derivative), acrylamide/diaryldimethylammonium chloride copolymers, acrylate/acrylamide/diarylamide hydrochloride copolymers, polyethylene imine, ethylene imine derivatives such as acrylamine polymers, alkylene oxide modified polyethylene imine, etc. These compounds can be used alone or in combination.

The coating method for forming the coating layer of the recording medium is not particularly limited. For example, direct coating methods, transfer methods in which a layer coated on a medium is transferred to the recording medium, and spraying methods in which a coating liquid is sprayed can be used.

Specific examples of the direct coating methods include film transfer methods such as roll coating methods, air knife coating methods, gate roll coating methods, size press coating methods, symsizer methods, and rod metalling size press coating methods; blade coating methods using fountain and roll application; etc. In addition, cast coating methods can also be used to form highly glossy coating layer.

Among these coating methods, it is preferable to use a size press machine, a gate roll size press machine, or a film transfer size press machine, which is attached to a paper machine so as to perform on-machine coating, in view of manufacturing costs.

The weight of the coating layer is not particularly limited, but is preferably from 0.5 to 25 g/m$^2$ on a dry basis. When the coating weight is less than 0.5 g/m$^2$, the colorant included in the ink droplets formed on the surface of the ink receiving layer cannot be well separated from the ink, i.e., the colorant tends to penetrate into the receiving paper, resulting in formation of images with low image density and/or blurred images. After the coating liquid for the ink receiving layer is coated or penetrated into the substrate, the coated liquid is preferably dried. The drying temperature is not particularly limited, but is preferably from 100 to 250° C. The drying operation is performed using a device such as hot air chambers and heat drums. In addition, after the coating operation or the drying operation, the coated paper may be subjected to a calender treatment to make the ink receiving layer smooth and/or to increase the mechanical strength of the surface of the ink receiving layer. In the calender treatment, devices such as super calenders, soft calenders and gloss calenders can be used.

The weight of the recording medium for use in the image recording method of the present invention is preferably from 100 to 300 g/m$^2$. When the weight is less than 100 g/m$^2$, the receiving medium has too low stiffness, and therefore the medium seems not to be high-finished. In contrast, when the weight is greater than 300 g/m$^2$, the recording medium has too high stiffness, thereby causing a problem in that the recording medium cannot be well turned in a turning portion of a recording device, resulting in defective feeding or jamming of the recording medium or formation of defective images.

In the image recording method of the present invention, the recording medium preferably has a relatively low ink absorbing property than that of conventional inkjet recording media because the final glossiness imparting treatment can be uniformly performed on the recorded images. Specifically, when the recording medium has too high ink absorbing property, the OP varnish coated on the recorded image is easily absorbed by the recording medium, resulting in formation of an uneven glossiness imparting layer, i.e., formation of an image with low glossiness. In this case, if the coating weight of the OP varnish is increased, the following problems tend to be caused:

(1) The running costs increase;

(2) It takes a long time until the coated OP varnish is dried by an oxidation polymerization method or an UV crosslinking method, or the coated OP varnish remains non-crosslinked; and (3) The glossiness imparting layer has uneven glossiness (spot-form unevenness).

Specific examples of such recording media having a relatively low ink absorbing property include cast coated papers. Cast coated papers form a category when coated papers are classified in view of the manufacturing method instead of the coating weight. Cast coated papers are typically prepared by a method in which a coated paper is contacted with a heated roller (cast drum) having a mirror surface to transfer the mirror surface to the coated layer, resulting in formation of coated papers having a smooth surface. The weight of the coating layer of the cast coated papers is typically from 20 to 30 g/m$^2$. Specific examples of the marketed cast coated papers include MIRROR COAT PLATINUM (from Oji Paper Co., Ltd.) and ESPRIT COAT C (from Nippon Paper Industries, Co., Ltd.).

The recording medium for use in the present invention is not limited to cast coated papers, and any coated papers satisfying the above-mentioned ink absorbing property can be used therefor because high quality images can be formed thereon by the image recording method of the present invention. Specific examples of such coated papers include art papers (falling under categories A0 and A1 when classified by the method defined by Ministry of Economy, Trade and Industry or Japan Paper Association), coated papers (falling under categories A2 and B2), light-weight coated papers (falling under categories A3 and B3), ultra light coated papers, etc., all of which are typically used for commercial printing fields (such as offset printing and gravure printing). In this regard, the art papers have a coating layer having a weight of not less than 20 g/m$^2$ on one or both sides thereof. The coated papers have a coating layer having a weight of from 10 to 20 g/m$^2$ on one or both sides thereof. The light weight coated papers have a coating layer having a weight of from 6 to 10 g/m$^2$ on one or both sides thereof. The ultra light weight coated papers have a coating layer having a weight of not greater than 6 g/m$^2$ on one or both sides thereof.

Specific examples of the marketed art papers include OK KINFUJI N, OK KINFUNI R40N, SA KINFUJI N, SATIN KINFUJI N, SATIN KINFUJI R-40N, ULTRA SATIN KINFUJI N, ULTRA OK KINFUJI N, and KINFUJI ONE SIDE, which are from Oji Paper Co., Ltd.; NPi SPECIAL ART, NPi SUPER ART, NPi SUPER DULL, and NPi DULL ART, which are from Nippon Paper Industries, Co., Ltd.; HIGH QUALITY ART A, SPECIAL DIA ART, SUPER MATTE ART A, and HIGH QUALITY DULL ART A, which are from Mitsubishi Paper Mills Ltd.; RAICHO SUPER ART N, RAICHO SUPER ART MN, RAICHO SPECIAL ART, and RAICHO DULL ART N, which are from Chuetsu Pulp & Paper Co., Ltd.; etc.

Specific examples of the A2 coated papers include OP TOP COAT PLUS, OP TOP COAT S, OK CASABLANCA, OK CASABLANCA V, OK TRINITY, OK TRINITY NaVi, NEW AGE, NEW AGE W, OK TOP COAT MATTE N, OK LOYAl COAT, OK TOP COAT DULL, Z COAT, OK BULK QUEEN, OK BULK KING, OK BULK KING SATIN, OK NONWRNCLE, OK COAT V, OK COAT N GREEN 100, OK MATTE COAT N GREEN 100, NEW AGE GREEN 100, and Z COAT GREEN 100, which are from Oji Paper Co., Ltd.; AURORA COAT, SHIORAI MATTE, INPERIAL MATTE, SILVER DIA, RECYCLE COAT 100, RECYCLE MATTE 100, and CYCLE MATTE 100, which are from Nippon Paper Industries, Co., Ltd.; MU COAT, MU WHITE, MU MATTE, and WHITE MU MATTE, which are from Hokuetsu Paper Mills, Ltd.; RAICHO COAT N, REGINA RAICHO COAT 100, RAICHO MATTE COAT N, and REGINA RAICHO MATTE 100, which are from Chuetsu Pulp & Paper Co., Ltd.; PEARL COAT, WHITE PEARL COAT N, NEW V MATTE, WHITE NEW V MATTE, PEARL COAT REW, WHITE PEARL COAT NREW, NEW V MATTE REW, and WHITE NEW V MATTE REW, which are from Mitsubishi Paper Mills Ltd.; etc.

Specific examples of the A3 coated papers (light coated paper) include OK COAT N, ROYAL COAT L, OK COAT LR, OK WHITE L, OK ROYAL COAT LR, OK COAT L GREEN 100, and OK MATTE COAT L GREEN 100, which are from Oji Paper Co., Ltd.; EASTER DX, RECYCLE COAT L100, AURORA L, RECYCLE MATTE L100, and <SSS> ENERGY WHITE, which are from Nippon Paper Industries, Co., Ltd.; UTRILLO COAT L, and MATTISSE COAT, which are from Daio Paper Corp.; HI-ALFA, ALFA-MATTE, (N) KINMARI L, and KINMARI HiL, which are from Hokuetsu Paper Mills, Ltd.; N PEARL COAT L, N PEARL COAT LREW, and SWING MATTE REW, which are from Mitsubishi Paper Mills Ltd.; SUPER EMINE, EMINE, and CHATON, which are from Chuetsu Pulp & Paper Co., Ltd.; etc.

Specific examples of the B2 coated papers (medium quality coated paper) include OK MEDIUM QUALITY COAT, (F)MCOP, OK ASTRO GLOSS, OK ASTRO DULL, and OK ASTRO MATTE, which are from Oji Paper Co., Ltd.; KING O, which is from Nippon Paper Industries, Co., Ltd.; etc.

Specific examples of the ultra light weight coated papers include OK ROYAL LIGHT S GREEN 100, OK EVER LIGHT COAT, OK EVER LIGHT R, OK EVER GREEN, CLEAN HIT MG, OK ULTRA LIGHT SUPER ECO G, ECO GREEN DULL, OK ULTRA LIGHTMATTE ECO G 100, OK STAR LIGHT COAT, OK SOFT ROYAL, OK BRIGHT, CLEAN HIT G, YAMAYURI BRIGHT, YAMAYURI BRIGHT G, OK AQUA LIGHT COAT, OK ROYAL LIGHT S GREEN 100, OK BRIGHT (ROUGH/GLOSS), SNOW MATTE, SNOW MATTE DX, OK BULK QUEEN, and OK BULK LILY, which are from Oji Paper Co., Ltd.; PYRENEES DX, PEGASUS HYPER 8, AURORA S, ANDES DX, SUPER ANDES DX, SPACE DX, SEINE DX, SPECIAL GRAVURE DX, PEGASUS, SILVER PEGASUS, PEGASUS HARMONY, GREENLAND DX100, SUPER GREENLAND DX100, <SSS> ENERGY SOFT, <SSS> ENERGY LIGHT, and EE HENRY, which are from Nippon Paper Industries, Co., Ltd.; CANT EXCEL, EXCEL SUPER B, EXCEL SUPER C, CANT EXCEL VAL, UTRILLO EXCEL, HEINE EXCEL, and DANTE EXCEL, which are from Daio Paper Corp.; COSMO ACE, which is from Nippon Daishowa Paperboard Co., Ltd.; SEMI HIGH L, HI-BETA, HI-GAMMA, SHIROMARI L, HAMMING, WHITE HAMMING, SEMI HIGH HiL, and SHIROMARI HiL, which are from Hokuetsu Paper Mills, Ltd.; RUBY LIGHT HREW, PEARL SOFT, and RUBY LIGHT H, which are from Mitsubishi Paper Mills Ltd.; CHATON, ARISO, and SMASH, which are from Chuetsu Pulp & Paper Co., Ltd.; STAR CHERRY, and CHERRY SUPER, which are from Marusumi Paper Co., Ltd.; etc.

Other coated papers can be used if the coated papers fulfill the above-mentioned requirement. For example, coated papers for use in electrophotography, and coated papers for use in gravure printing can be used. Specific examples thereof include POD GLOSS COAT from Oji Paper Co., Ltd.; SPACE DX and ACE from Nippon Paper Industries, Co., Ltd.; etc. Since the coating layers of these papers have a proper void volume, the papers can be preferably used as the recording medium.

The surface of the recording medium for use in the present invention preferably has a 60°-glossiness (i.e., glossiness measured at an angle of 60°) of not lower than 50%, and more preferably not lower than 70%. In this application, the 60°-glossiness is measured with the method defined in JIS ZS 8741. When the 60°-glossiness is too low, the resultant prints seem not to be glossy.

Next, the image recording method of the present invention will be explained.

The image recording method of the present invention includes at least (1) an image forming process of ejecting the above-mentioned ink to form an ink image on a surface of the above-mentioned recording medium; and (2) a glossiness imparting process of applying a glossiness imparting liquid on the surface of the recording medium bearing the ink image.

The image forming process is preferably performed by the ink ejecting device of the inkjet recording device mentioned below. In this regard, the ink ejecting conditions are preferably as follows:

(1) Volume of an inkjet droplet ejected by the ejecting device to form a dot image: 1 to 40 pl;
(2) Speed of ejected inkjet droplets: 5 to 20 m/s;
(3) Drive frequency: not less than 1 kHz; and
(4) Resolution of recorded images: not less than 300 dpi.

It is preferable for the image recording method that the colorant included in the ink adhered to the recording medium is mainly located in a surface portion of the medium without excessively penetrating into the medium, and the total amount of ink adhered to the recording medium is controlled so as to be not greater than a predetermined amount. In this regard, the total amount of ink (hereinafter sometimes referred to as ink weight) is used an important parameter in forming high quality images, and is defined as the weight of the ink adhered to the recording medium per a unit area. By ejecting the ink while controlling the ink weight, good images with little beading and bleeding can be formed even on a recording medium having poor ink absorbing property. When the ink weight is larger than the predetermined weight like a conventional inkjet recording method, problems in that the colorant in the ink penetrates into the recording medium together with the solvent therein, and the solvent included in the ink cannot sufficiently penetrate into the recording medium, resulting in deterioration of image qualities tend to occur.

Specifically, the maximum ink weight is preferably 15 $g/m^2$, and more preferably 12 $g/m^2$, to form high quality images without beading and bleeding.

Unlike conventional inkjet images recorded by a combination of a dye ink and an inkjet recording medium, the inkjet images recorded on the recording medium, mentioned above using the pigment ink mentioned above have a configuration such that the colorant included in the ink is mainly present on the surface of the receiving medium. Therefore, in this image recording method, the amount of the colorant needed for forming a high quality image is the amount in which the colorant can cover the surface of the recording medium. If the colorant is present in the ink droplet in an amount greater than the desired amount, the excess colorant is wasteful, and in addition the solvent included in an ink droplet interferes with the adjacent ink droplet, resulting in formation of beading and bleeding even when such a highly penetrating ink as mentioned above is used.

When the ink weight is greater than the above-mentioned weight, a large amount of ink is used for forming a solid image or a shadow image, and thereby the recording medium cannot well separate the colorant from the ink. In this case, problems in that blurred images are formed, and the image recorded on the recording medium is not sufficiently dried even when the ink mentioned above for use in the present invention is used tend to occur.

In addition, since the ink weight can be thus decreased in the image recording method of the present invention, the volume of the ink cartridge can be decreased compared with that of conventional ink cartridges, resulting in miniaturization of the inkjet printer. If the volume of the ink cartridge is the same as that of conventional ink cartridges, the exchange frequency of the ink cartridge can be decreased and the running costs can be reduced.

As for the ink weight, the less the ink weight, the better the pigment separation ability of the recording medium can be exhibited. However, when the ink weight is too light, the ink dot images have too small a diameter, resulting in formation of images with low image density and unevenness. Therefore, it is preferable to properly control the ink weight in the above-mentioned range.

In this application, the ink weight is determined by the following method.

(1) A rectangular solid image with a size of 5 cm×20 cm is formed on a sheet of an inkjet recording medium SUPER FINE PAPER from Seiko Epson Corp. so as to have the maximum image density, wherein the weight (W1) of the sheet is measured before recording;
(2) The weight (W2) of the recording medium having the solid image is measured just after recording the image to determine the weight difference (W2−W1); and
(3) The weight difference is multiplied by 100 to determine the ink weight per a unit area of 1 $m^2$.

Next, the glossiness imparting process of the image recording method of the present invention will be explained.

Conventional glossiness imparting liquid coating methods for use in the printing fields can also be used for the image recording method of the present invention. Specifically, a glossiness imparting liquid is applied on the surface of the recording medium bearing an inkjet image thereon using a coating device such as bar coater, offset printers, screen printers, and roll coaters. In addition, inkjet methods can also be used for applying a glossiness imparting liquid.

The weight of the thus formed glossiness imparting layer is generally from 0.3 to 20 $g/m^2$, and preferably from 1 to 10 $g/m^2$. When the weight is greater than 20 $g/m^2$, problems in that the coated liquid is not sufficiently dried, and the resultant recording medium has an uneven surface like orange peel tend to be caused. In contrast, when the weight is less than 0.3 $g/m^2$, the resultant print tends to have a low glossiness.

Next, the ink cartridge will be explained.

The ink cartridge for use in the image recording method includes a container containing the ink mentioned above, and optionally includes other members. The container is not particularly limited, and the shape, structure, size, and constitutional material of the container are determined depending on the application of the ink cartridge. For example, an ink bag formed of an aluminum laminated film or a resin film can be used.

The ink cartridge will be explained by reference to FIGS. 1 and 2.

Figure 2:
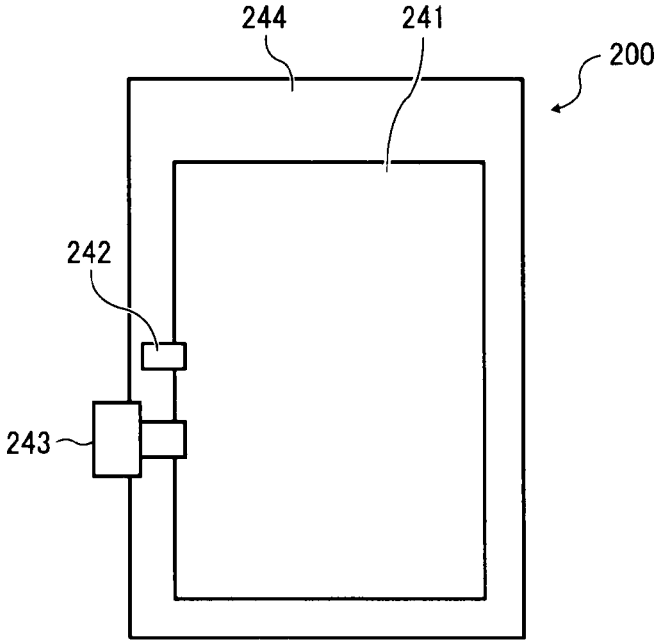
FIG. 2 is a schematic view illustrating the ink cartridge illustrated in FIG. 1 with a case.

FIG. 1 illustrates an example of the ink cartridge, and FIG. 2 illustrates the ink cartridge contained in a case.

Referring to FIGS. 1 and 2, an ink cartridge 200 has an ink bag 241; an ink inlet 242, from which the ink is injected to the ink bag 241; and an ink outlet 243, which is made of a rubber and from which the ink in the bag is discharged to an inkjet recording device. After the ink is injected into the ink bag 241, the inlet 242 is sealed. When the ink cartridge is used, a needle is inserted into the ink outlet 243 from the inkjet recording device so that the ink in the ink bag 241 is supplied to the recording device. Numeral 244 denotes a case of the ink cartridge.

Next, the inkjet recording device for use in the image recording method of the present invention will be explained.

The inkjet recording device includes at least an ink ejecting device configured to eject the ink toward the recording medium, and optionally includes other devices such as impulse generating devices configured to generate impulse for use in ejecting the ink, and controllers configured to control the operations of the inkjet recording device.

The ink ejecting device applies impulse, which has been generated by an impulse generating device, to the ink to eject ink droplets, i.e., to form an ink image. The ink ejecting device is not particularly limited, and for example any known inkjet nozzles can be used therefor.

It is preferable that at least one portion of the liquid chamber, liquid resistive portion, vibrating plate, and inkjet nozzle (all of which will be explained below) of the ejecting device is made of a material including at least one of silicon and nickel. The diameter of the inkjet nozzle is preferably not greater than 30 μm, and more preferably from 1 to 20 μm.

The above-mentioned impulse can be generated by the above-mentioned impulse generating device. The impulse is not particularly limited, and impulses such as heat, pressure, vibration, and light can be used. These impulses can be used alone or in combination. Among these impulses, heat and pressure are preferably used.

In the image recording method of the present invention, the ink ejecting method is not particularly limited. The ink ejecting method changes depending on the impulses applied to eject the ink. For example, when heat is used as the impulse, methods having the following steps can be used:

(1) applying heat energy to the ink according to a recording signal using a device such as thermal heads to form air bubble in the ink; and (2) ejecting an ink droplet from a nozzle of the recording head by the pressure of the air bubble.

For example, when pressure is used as the impulse, methods having the following step can be used:

(1) applying a voltage to a piezoelectric element arranged on a pressure chamber located in an ink flow path of a recording head according to a recording signal to bend the piezoelectric element, resulting in reduction of volume of the pressure chamber, thereby ejecting an ink droplet from a nozzle of the recording head.

An example of the inkjet recording method of the present invention will be explained by reference to drawings.

Figure 3:
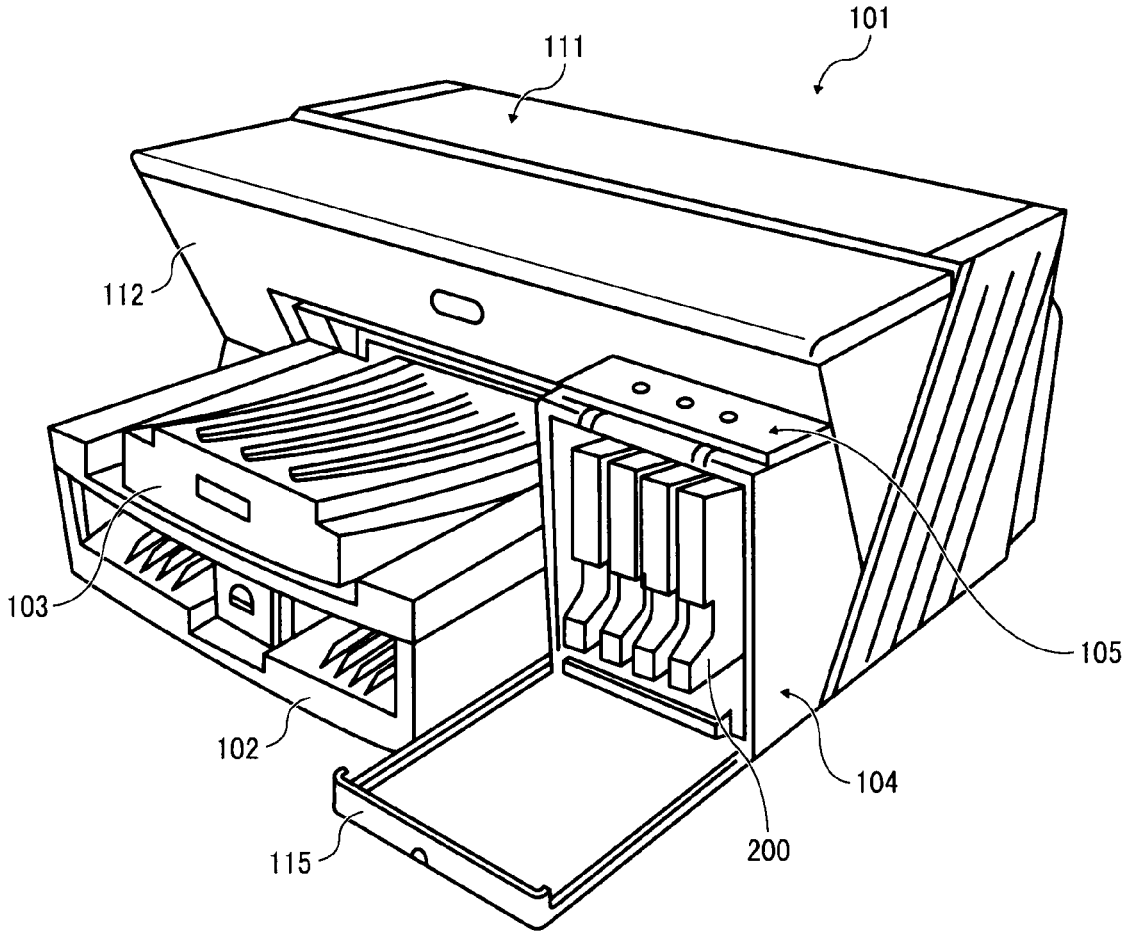
FIG. 3 is a schematic perspective view illustrating an inkjet recording device for use in the image recording method of the present invention, whose cover for the ink cartridge is opened.

FIG. 3 illustrates an inkjet recording device for use in the image recording method of the present invention. Referring to FIG. 3, the inkjet recording device includes a main body 101, a recording medium loading tray 102, which is attached to the main body 101 and which is configured to load a recording medium into the inkjet recording device, a copy tray 103 configured to receive a print (i.e., a recording medium bearing an image thereon), an ink cartridge containing portion 104 configured to contain ink cartridges 200 therein, and an operation panel 105 located on the ink cartridge containing portion and including an input member such as operation keys and a display member. The ink cartridge containing portion 104 has a front cover 115, which can be opened and closed to attach and detach the ink cartridges 200. In FIG. 3, numerals 111 and 112 respectively denote an upper cover of the main body 101, and a front portion of the main body 101.

Figure 4:
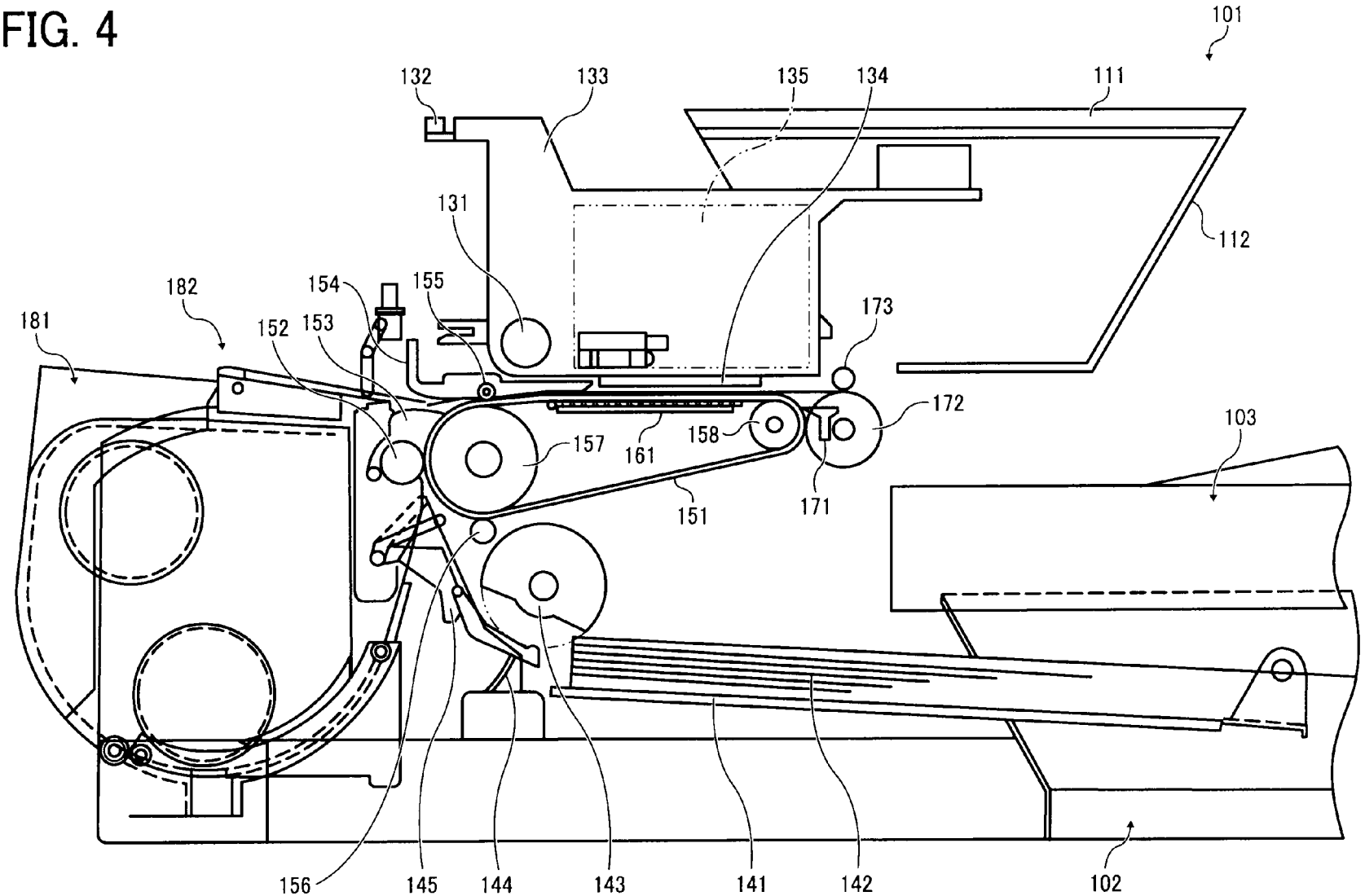
FIG. 4 is a schematic cross-sectional view illustrating the inkjet recording device illustrated in FIG. 3.
Figure 5:
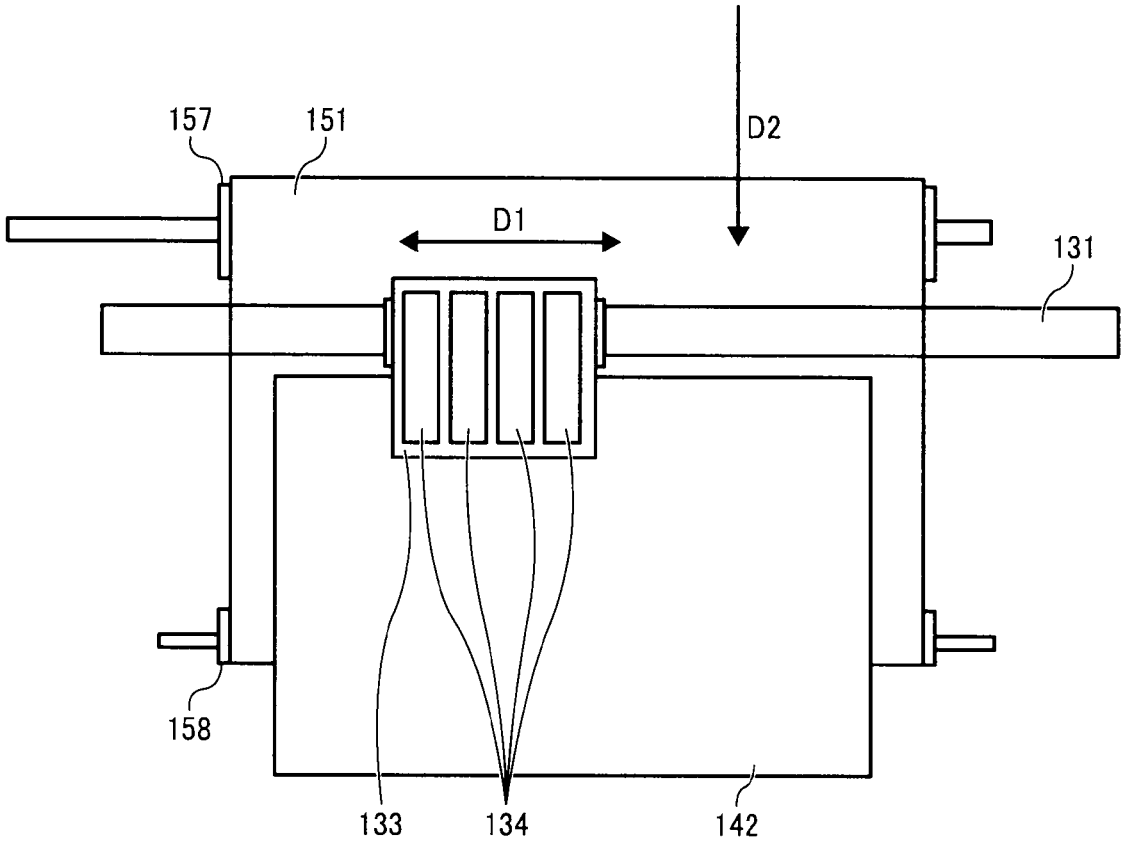
FIG. 5 is a schematic view illustrating the inkjet recording head of the inkjet recording device illustrated in FIGS. 3 and 4.

FIG. 4 is a schematic cross-sectional view illustrating the inkjet recording device illustrated in FIG. 3, and FIG. 5 is a schematic view illustrating the inkjet head of the inkjet recording device illustrated in FIGS. 3 and 4.

Referring to FIGS. 4 and 5, the main body 101 includes guide members, i.e., a guide rod 131 and a stay 132, which are supported by side walls (not shown) of the inkjet recording device and which support a carriage 133 including inkjet heads 134 so that the carriage is slid in a main scanning direction D1 by a main scanning motor to perform main scanning. On the other hand, one of sheets 142 stacked on a sheet setting portion 141 is fed by a feeding roller 143 toward a nip between a second feeding roller 157 and a counter roller 152 while guided by a guide member 145. Numeral 144 denotes a separation pad. The sheet 142 is then fed by the second feeding roller 157, the counter roller 152 and a feeding belt 151 (rotated by the roller 157 and a tension roller 158) toward a pressure roller 155 while guided by guide members 153 and 154. The sheet 142 is further fed on a guide plate 161 in a sub-scanning direction D2 by the pressure roller 155 so that a color image is formed on the sheet by the inkjet heads 134. The sheet 142 bearing a color image thereon is then discharged from the main body 101 by a pair of rollers 172 and 173. Numerals 171 and 156 respectively denote a separation pick configured to separate the sheet from the belt 151, and a charging roller configured to charge the belt 151 so that the sheet 142 is adhered to the belt. In FIG. 4, numerals 181 and 182 respectively denote a feeding unit for forming a double sided print, and a manual sheet feeder. In addition, numeral 135 denotes a sub-tank of the inks.

Hereinafter, the inkjet head for use in the image recording method will be explained.

Figure 6:
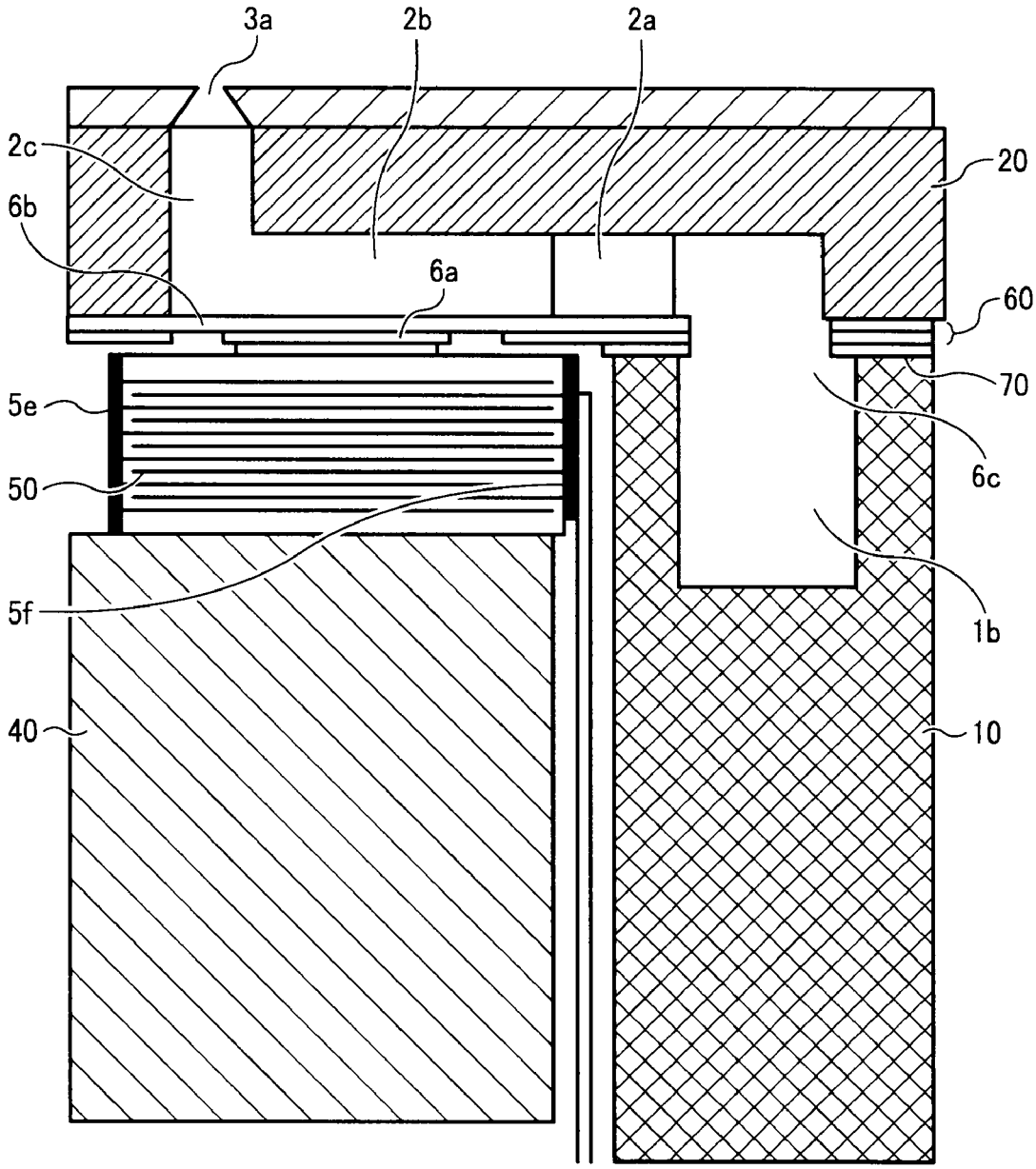
FIG. 6 is a schematic view illustrating the inkjet recording head illustrated in FIG. 5.
Figure 7:
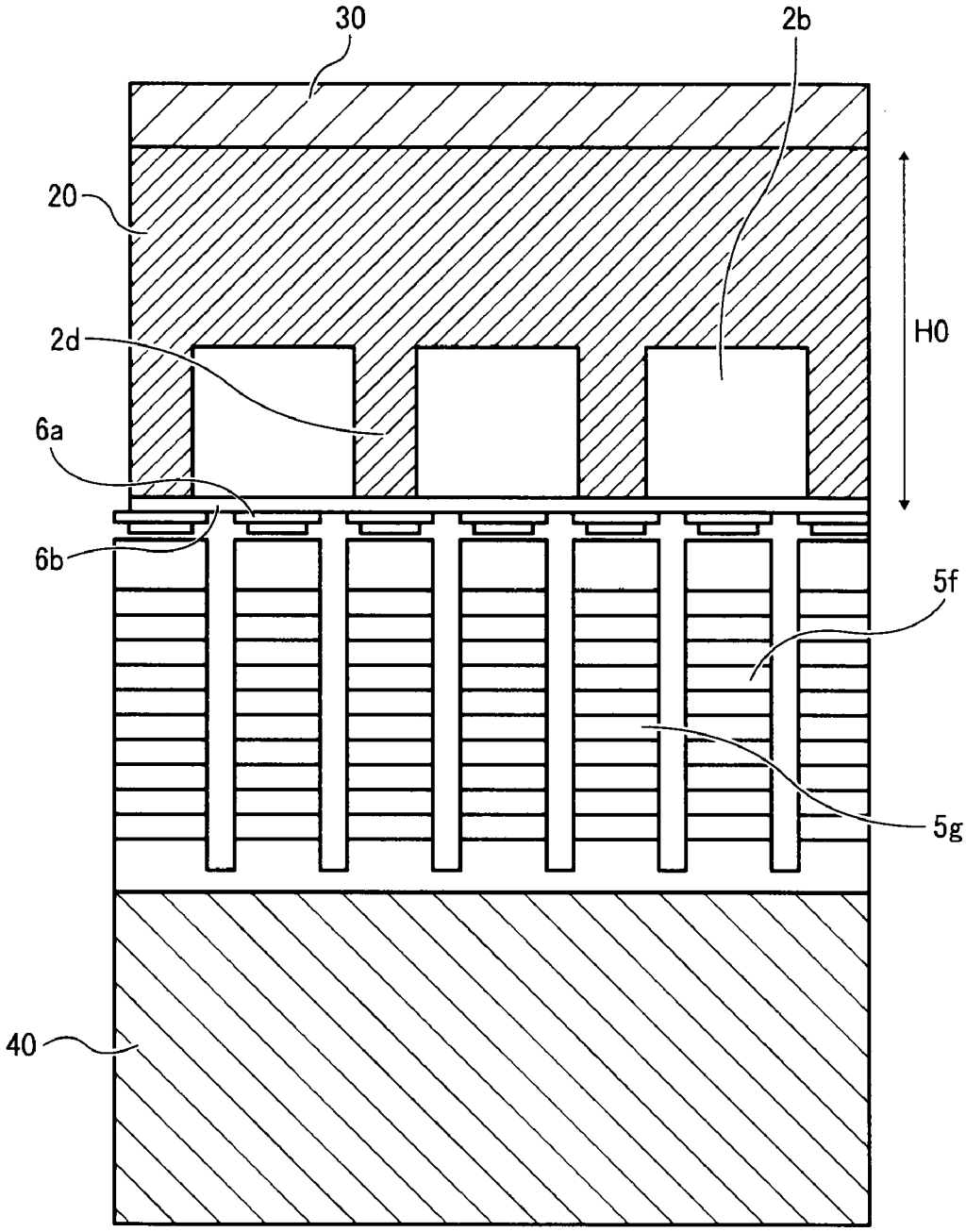
FIG. 7 is a schematic view illustrating a portion of the inkjet recording head illustrated in FIG. 6.

FIG. 6 is a schematic view illustrating elements of the inkjet head illustrated in FIG. 5, and FIG. 7 is a schematic view illustrating a portion of the inkjet head illustrated in FIG. 6.

The inkjet head illustrated in FIG. 6 has a frame 10 having an ink supplying opening (not shown), a common liquid chamber 1*b*, which is formed by carving a portion of the frame; a flow path plate 20 having a liquid resistive portion 2*a* and a pressure liquid chamber 2*b*, each of which is formed by carving a portion of the flow path plate 20, and a hole 2*c* connected with a nozzle 3*a*; a nozzle plate having the nozzle 3*a*; a vibrating plate 60 having a projected portion 6*a*, a diaphragm 6*b*, and an ink entrance 6*c*; a multilayer piezoelectric element 50, which is connected with the vibrating plate 60 with an adhesive layer 70 therebetween and which has a driving portion 5*f* and a supporting portion 5*g*; and a base 40 configured to fixedly support the piezoelectric element 50.

The base 40 is made of a barium titanate-based ceramic, and has a configuration such that two lines of the piezoelectric element 50 are arranged while connected.

In FIG. 7, numeral 2*d* denotes a bulkhead.

The ink prints formed by the image recording method of the present invention have high qualities without blurring, and good preservation stability. Therefore, the ink prints can be preferably used as documents for use in various fields.

Figure 8A:
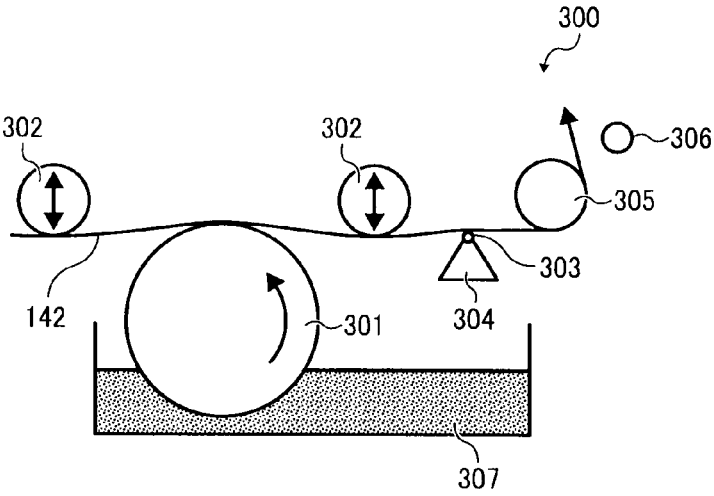
FIGS. 8A to 8C are schematic views illustrating examples of the coating device for coating a glossiness imparting liquid on the surface of a recording medium.
Figure 8B:
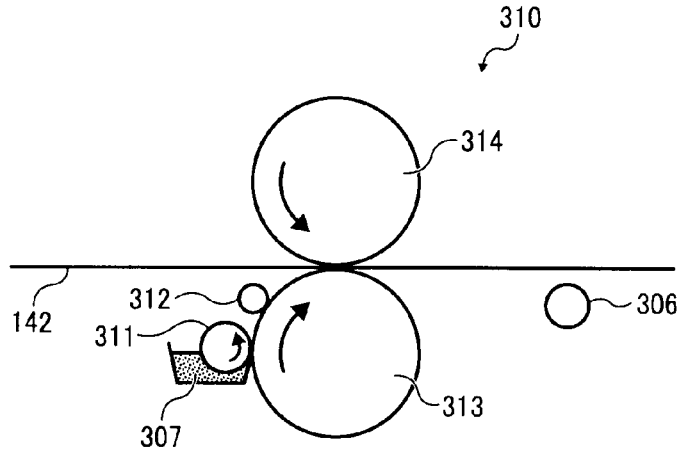
Figure 8C:
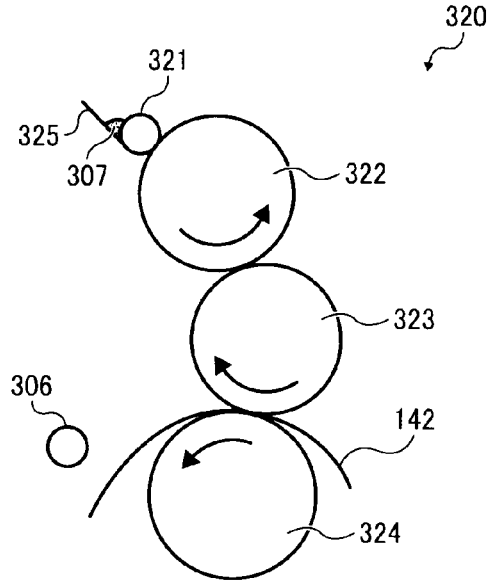

After an ink image is formed on the recording medium 142, a glossiness imparting liquid is coated on the surface of the recording medium with a coating device. Examples of the coating device include bar coaters, offset printers, screen printers, and roll coaters. FIGS. 8A, 8B and 8C respectively illustrate a bar coater, a roll coater and an offset printer.

FIG. 8A illustrates a bar coater 300. The bar coater 300 includes an application roller 301 configured to apply a glossiness imparting liquid 307 to a surface of the recording medium 142 bearing an ink image thereon; pressure rollers 302 configured to press the recording medium 142; a bar 303 which is supported by a support and which is configured to smooth the coated glossiness imparting liquid 307 so that a predetermined amount of the glossiness imparting liquid is applied on the surface of the recording medium; and a feeding roller 305 configured to feed the recording medium 142. The thus coated glossiness imparting liquid is dried to form a glossiness imparting layer. When the coated glossiness imparting liquid 307 includes an UV crosslinking material, it is preferable to irradiate the coated glossiness imparting liquid with ultraviolet rays using a lamp 306 to cross link the UV crosslinking material.

FIG. 8B illustrates a roll coater 310. The roll coater 310 includes a coating roller 313 configured to apply the glossiness imparting liquid 307 to a surface of the recording medium 142 bearing an ink image thereof; an application roller 311 configured to apply the glossiness imparting liquid 307 to the coating roller 313; a backup roller 314 configured to press the recording medium to the coating roller 313 while feeding the recording medium; and a reverse roller 312 configured to smooth the applied glossiness imparting liquid 307 so that a predetermined amount of glossiness imparting liquid layer is formed on the coating roller. Similarly to the coating device 300, it is preferable to irradiate the coated glossiness imparting liquid with ultraviolet rays using the lamp 306 when the coated glossiness imparting liquid 307 includes an UV crosslinking material.

FIG. 8C illustrates an offset printer 320. The offset coater 320 includes an application roller 321; a first roller 322; a second roller 323; and a backup roller 324. The application roller 321 applies the glossiness imparting liquid 307 to the first roller 322, which transfer the glossiness imparting liquid to the second roller 323. The glossiness imparting liquid 307 on the second roller 323 is then transferred onto a surface of the recording medium 142 bearing an ink image thereon. Similarly to the coating device 300, it is preferable to irradiate the coated glossiness imparting liquid with ultraviolet rays using the lamp 306 when the coated glossiness imparting liquid 307 includes an UV crosslinking material.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

At first, inks were prepared.

Dispersion Preparation Example 1

(Preparation of Cyan Colorant Dispersion)

After replacing air in a 1-liter flask, which is equipped with a mechanical agitator, a thermometer, a nitrogen gas feed pipe, a reflux condenser, and a dropping funnel, with a nitrogen gas, the following components were fed into the flask.

| | |
|---|---|
| Styrene | 11.2 g |
| Acrylic acid | 2.8 g |
| Lauryl methacrylate | 12.0 g |
| Polyethylene glycol methacrylate | 4.0 g |

-continued

| | |
|---|---|
| Styrene macromer (AS-6 from Toa Gosei Chemical Industry Co., Ltd.) | 4.0 g |
| Mercaptoethanol | 0.4 g |

The mixture was heated to 65° C.

Next, the following components were mixed in a beaker to prepare a second mixture.

| | |
|---|---|
| Styrene | 100.8 g |
| Acrylic acid | 25.2 g |
| Lauryl methacrylate | 108.0 g |
| Polyethylene glycol methacrylate | 36.0 g |
| Hydroxyethyl methacrylate | 60.0 g |
| Styrene macromer (AS-6 from Toa Gosei Chemical Industry Co., Ltd.) | 36.0 g |
| Mercaptoethanol | 3.6 g |
| Azobisdimethyl valeronitrile | 2.4 g |
| Methyl ethyl ketone | 18 g |

The second mixture was dropped into the flask containing the first-mentioned mixture over 2.5 hours.

After adding the second mixture, a mixture of 0.8 g of azobisdimethyl valeronitrile, and 18 g of methyl ethyl ketone was dropped into the flask over 0.5 hours. After the mixture was aged for 1 hour at 65° C., 0.8 g of azobisdimethyl valeronitrile was fed into the flask, followed by aging for 1 hour.

After the reaction was completed, 364 g of methyl ethyl ketone was added to the flask. Thus, 800 g of a polymer solution having a solid content of 50% by weight was prepared. In addition, a part of the polymer solution was dried and the weight average molecular weight (Mw) of the polymer was measured with gel permeation chromatography using polystyrene and tetrahydrofuran as the reference and solvent. As a result, it was confirmed that the polymer has a weight average molecular weight (Mw) of 15,000.

Next, the following components were mixed while agitated.

| | |
|---|---|
| The polymer solution prepared above | 28 g |
| Copper phthalocyanine pigment | 26 g |
| 1 mol/l aqueous solution of potassium hydroxide | 13.6 g |
| Methyl ethyl ketone | 20 g |
| Ion exchange water | 30 g |

The mixture was kneaded 20 times using a three roll mill (NR-84A from Noritake Co., Ltd.). The thus prepared paste was fed into 200 g of ion exchange water, and the mixture was well agitated. In addition, methyl ethyl ketone and water were removed from the mixture using an evaporator. Thus, 160 g of a blue (cyan) polymer dispersion having a solid content of 20.0% by weight was prepared. When the average particle diameter was measured with a particle distribution analyzer, MICROTRACK UPA from Nikkiso Co., Ltd., it was confirmed that the particulate cyan polymer in the dispersion has an average particle diameter (D50%) of 93 nm.

Thus, a particulate cyan polymer including a copper phthalocyanine pigment therein was prepared.

Dispersion Preparation Example 2

(Preparation of Magenta Colorant Dispersion)

The procedure for preparation of the particulate cyan polymer in Dispersion Preparation Example 1 was repeated except that the copper phthalocyanine pigment was replaced with Pigment Red 122. Thus, a particulate magenta polymer including a dimethylquinacridone pigment therein was prepared. It was confirmed that the particulate magenta polymer has an average particle diameter (D50%) of 127 nm.

Dispersion Preparation Example 3

(Preparation of Yellow Colorant Dispersion)

The procedure for preparation of the particulate cyan polymer in Dispersion Preparation Example 1 was repeated except that the copper phthalocyanine pigment was replaced with Pigment Yellow 74. Thus, a particulate yellow polymer including a monoazo pigment therein was prepared. It was confirmed that the particulate yellow polymer has an average particle diameter (D50%) of 76 nm.

Dispersion Preparation Example 4

(Preparation of Black Colorant Dispersion)

The procedure for preparation of the particulate cyan polymer in Dispersion Preparation Example 1 was repeated except that the copper phthalocyanine pigment was replaced with a carbon black (FW-100 from Degussa AG). Thus, a particulate black polymer including a carbon black therein was prepared. It was confirmed that the particulate black polymer has an average particle diameter (D50%) of 104 nm.

Next, inks were prepared using the above-prepared colorants.

Ink Preparation Example 1

(Preparation of Cyan Ink 1)

The following components were mixed.

| | |
|---|---|
| Cyan colorant dispersion prepared above | 20.0 parts |
| 3-methyl-1,3-butanediol | 23.0 parts |
| Glycerin | 8.0 parts |
| 2-ethyl-1,3-hexanediol | 2.0 parts |
| Fluorine-containing surfactant (FS-300 from DuPont) | 2.5 parts |
| Fungicide (PROXEL LV from Avecia Ltd.) | 0.2 parts |
| 2-amino-2-ethyl-1,3-propanediol | 0.5 parts |
| Ion exchange water | 43.8 parts |

After the mixture was filtered using a membrane filter having openings of 0.8 μm, the mixture was mixed with ion exchange water to adjust the solid content so as to be the content described in Table 2.

Thus, a cyan ink 1 was prepared.

Ink Preparation Example 2

(Preparation of Magenta Ink 1)

The following components were mixed.

| | |
|---|---|
| Magenta colorant dispersion prepared above | 20.0 parts |
| 3-methyl-1,3-butanediol | 22.5 parts |
| Glycerin | 9.0 parts |
| 2-ethyl-1,3-hexanediol | 2.0 parts |
| Fluorine-containing surfactant (FS-300 from DuPont) | 2.5 parts |
| Fungicide (PROXEL LV from Avecia Ltd.) | 0.2 parts |
| 2-amino-2-ethyl-1,3-propanediol | 0.5 parts |
| Ion exchange water | 43.3 parts |

After the mixture was filtered using a membrane filter having openings of 0.8 μm, the mixture was mixed with ion exchange water to adjust the solid content so as to be the content described in Table 2.

Thus, a magenta ink 1 was prepared.

Ink Preparation Example 3

(Preparation of Yellow Ink 1)

The following components were mixed.

| | |
|---|---|
| Yellow colorant dispersion prepared above | 20.0 parts |
| 3-methyl-1,3-butanediol | 24.5 parts |
| Glycerin | 8.0 parts |
| 2-ethyl-1,3-hexanediol | 2.0 parts |
| Fluorine-containing surfactant (FS-300 from DuPont) | 2.5 parts |
| Fungicide (PROXEL LV from Avecia Ltd.) | 0.2 parts |
| 2-amino-2-ethyl-1,3-propanediol | 0.5 parts |
| Ion exchange water | 42.3 parts |

After the mixture was filtered using a membrane filter having openings of 0.8 μm, the mixture was mixed with ion exchange water to adjust the solid content so as to be the content described in Table 2.

Thus, a yellow ink 1 was prepared.

Ink Preparation Example 4

(Preparation of Black Ink 1)

The following components were mixed.

| | |
|---|---|
| Black colorant dispersion prepared above | 20.0 parts |
| 3-methyl-1,3-butanediol | 22.5 parts |
| Glycerin | 7.5 parts |
| 2-pyrrolidone | 2.0 parts |
| 2-ethyl-1,3-hexanediol | 2.0 parts |
| $R—(OCH_2CH_2)_nOH$ (R: alkyl group having 12 carbon atom, n: 9) | 2.0 parts |
| Fungicide (PROXEL LV from Avecia Ltd.) | 0.2 parts |
| 2-amino-2-ethyl-1,3-propanediol | 0.5 parts |
| Ion exchange water | 43.3 parts |

After the mixture was filtered using a membrane filter having openings of 0.8 μm, the mixture was mixed with ion exchange water to adjust the solid content so as to be the content described in Table 2.

Thus, a black ink 1 was prepared.

Ink Preparation Example 5

(Preparation of Cyan Ink 2)

The procedure for preparation of the cyan ink 1 in Ink Preparation Example 1 was repeated except that the solid content was changed to 5% by weight.

Thus, a cyan ink 2 was prepared.

Ink Preparation Example 6

(Preparation of Magenta Ink 2)

The procedure for preparation of the magenta ink 1 in Ink Preparation Example 2 was repeated except that the solid content was changed to 5% by weight.

Thus, a magenta ink 2 was prepared.

Ink Preparation Example 7

(Preparation of Yellow Ink 2)

The procedure for preparation of the yellow ink 1 in Ink Preparation Example 3 was repeated except that the solid content was changed to 5% by weight.

Thus, a yellow ink 2 was prepared.

Ink Preparation Example 8

(Preparation of Black Ink 2)

The procedure for preparation of the black ink 1 in Ink Preparation Example 4 was repeated except that the solid content was changed to 5% by weight.

Thus, a black ink 2 was prepared.

Ink Preparation Example 9

(Preparation of Cyan Ink 3)

The procedure for preparation of the cyan ink 1 in Ink Preparation Example 1 was repeated except that the fluorine-containing surfactant FS-300 was not added.

Thus, a cyan ink 3 was prepared.

Ink Preparation Example 10

(Preparation of Magenta Ink 3)

The procedure for preparation of the magenta ink 1 in Ink Preparation Example 2 was repeated except that the fluorine-containing surfactant FS-300 was not added.

Thus, a magenta ink 3 was prepared.

Ink Preparation Example 11

(Preparation of Yellow Ink 3)

The procedure for preparation of the yellow ink 1 in Ink Preparation Example 3 was repeated except that the fluorine-containing surfactant FS-300 was not added.

Thus, a yellow ink 3 was prepared.

Ink Preparation Example 12

(Preparation of Black Ink 3)

The procedure for preparation of the black ink 1 in Ink Preparation Example 4 was repeated except that the compound $R—(OCH_2CH_2)_nOH$ was not added.

Thus, a black ink 3 was prepared.

Ink Preparation Example 13

(Preparation of Set of Dye-Based Color Inks)

The following components were mixed, followed by pressure filtering using a FLUOROPORE filter (from Sumitomo Electric Industries, Ltd.) to prepare dye-based yellow, magenta, cyan and black inks.

Dye

Yellow dye: C.I. Direct Yellow 86

Cyan dye: C.I. Direct blue 199

Magenta dye: C.I. Acid Red 285

Black dye: C.I. Direct Black 154

Formula of Ink

| | |
|---|---|
| Dye | 4 parts |
| Glycerin | 7 parts |
| Thiodiglycol | 7 parts |

-continued

| | |
|---|---|
| Urea | 7 parts |
| Acetylene glycol | 1.5 parts |
| Water | 73.5 parts |

The viscosity and surface tension of the thus prepared inks were measured using a viscometer (R500 rotary viscometer from Toki Sangyo), and a combination of a surface tensiometer (CBVP-Z from Kyowa Interface Science Co., Ltd.) and a platinum plate, respectively. The results are shown in Table 1.

TABLE 1

| Ink | Viscosity (mPa · s) | Surface Tension (mN/m) | Ink | Viscosity (mPa · s) | Surface Tension (mN/m) |
|---|---|---|---|---|---|
| Cyan ink 1 | 9 | 25 | Cyan ink 3 | 9 | 33 |
| Magenta ink 1 | 9 | 25 | Magenta ink 3 | 9 | 33 |
| Yellow ink 1 | 9 | 25 | Yellow ink 3 | 9 | 33 |
| Black ink 1 | 9 | 25 | Black ink 3 | 9 | 33 |
| Cyan ink 2 | 5 | 25 | Dye ink (yellow) | 4 | 35 |
| Magenta ink 2 | 5 | 25 | Dye ink (magenta) | 4 | 35 |
| Yellow ink 2 | 5 | 25 | Dye ink (cyan) | 4 | 35 |
| Black ink 2 | 5 | 25 | Dye ink (Black) | 4 | 35 |

Next, the recording medium was prepared.

Preparation of Substrate 1

At first, a substrate 1 for use in the recording medium was prepared.

A slurry including the following components at a solid content of 0.3% by weight was prepared.

| | |
|---|---|
| LBKP | 80 parts |
| NBKP | 20 parts |
| Light calcium carbonate (TP-121 from Okutama Kogyo Co., Ltd.) | 10 parts |
| Aluminum sulfate | 1.0 part |
| Amphoteric starch (CATO 3210 from Nippon NSC Ltd.) | 1.0 part |
| Neutral rosin sizing agent (NEUSIZE M-10 from Harima Chemicals, Inc.) | 0.3 parts |
| Yield improving agent (NR-11LS from Hymo Co., Ltd.) | 0.02 parts |

A roll paper having a weight of 79 g/m$^2$ was prepared using the thus prepared slurry and a paper machine (fourdrinier), followed by a machine calender treatment. In this regard, this paper machine performed a size press coating process of coating an aqueous solution of an oxidized starch on both sides of the paper such that the weight of the oxidized starch is 1.0 g/m$^2$ on a dry basis per one side.

Thus, a substrate 1 was prepared.

Medium Preparation Example 1

(Preparation of Recording Paper 1 (Cast Coated Paper))

An aqueous pigment dispersion having a solid content of 65% by weight was prepared using the following components.

| | |
|---|---|
| Kaolin | 90 parts |
| Light calcium carbonate | 10 parts |
| Ground calcium carbonate | 5 parts |
| Sodium tripolyphosphate | 0.5 parts |
| Oxidized starch | 9 parts |
| Styrene-butadiene latex | 15 parts |
| Microcrystalline wax | 1 part |
| Trimethyl phosphate | 1 part |
| Water | balance |

The thus prepared aqueous pigment dispersion was coated on an undercoat layer formed on one side of the above-prepared substrate 1 in a coating amount of 20 g/m$^2$ on a dry basis. The coated layer in a wet state was contacted with a cast drum heated to 90° C. to be dried. Thus, a recording paper 1, which is a cast coated paper, was prepared.

Medium Preparation Example 2

(Preparation of Recording Paper 2 (Glossy Coated Paper))

An aqueous pigment dispersion having a solid content of 60% by weight was prepared using the following components.

| | |
|---|---|
| Kaolin (including particles having particle diameter of not greater than 2 μm in an amount of 97% by weight) | 70 parts |
| Ground calcium carbonate (average particle diameter of 1.1 μm) | 30 parts |
| Styrene - butadiene copolymer (serving as an adhesive and having a glass transition temperature of −5° C.) | 8 parts |
| Starch esterified with phosphoric acid | 1 part |
| Calcium stearate (serving as an auxiliary agent) | 0.5 parts |
| Water | balance |

The thus prepared aqueous pigment dispersion was coated on both sides of the substrate 1 using a blade coater, followed by drying using hot air so that the dried coated layer has a thickness of 10 μm per one side. The coated paper was subjected to a super calender treatment at a linear pressure of 20 kg/cm. Thus, a recording paper 2, which is a glossy coated paper, was prepared.

Medium Preparation Example 3

(Preparation of Recording Paper 3 (Matte Coated Paper))

The procedure for preparation of the recording paper 2 in Media Preparation Example 2 was repeated except that the super calender treatment was not performed. Thus, a recording paper 3, which is a matte coated paper, was prepared.

Examples 1

An ink set 1 consisting of the black ink 1, yellow ink 1, magenta ink 1 and cyan ink 1 was prepared. The ink set 1 was set in a pilot drop-on-demand printer having 384 nozzles having a nozzle resolution of 300 dpi to form a full color image having a resolution of 600 dpi and including solid images and character images on a recording medium (MIRROR COAT PLATINUM). In this regard, the recording conditions were as follows.

(1) Size of large droplets: 20 μl
(2) Size of medium droplets: 10 μl
(3) Size of small droplets: 2 μl
(4) Immutable weight control of secondary color: 140%
(5) Ink weight: 12 g/m$^2$ (when a solid image of 300 dots×300 dots was recorded)

After the glossiness of the thus formed image was measured, a UV varnish (UV VECTA COAT VARNISH PC-3KW2 from T&K Toka Company), which serves as a glossiness imparting liquid, was coated on the entire surface of the recording medium bearing the image thereon using an offset printer. The coating weight of the UV varnish is shown in Table 2. Next, the recording medium was exposed to UV light, which was emitted by one high pressure mercury lamp having a power of 160 W/cm), for 30 seconds to crosslink the coated UV varnish. The glossiness of the surface of the recording medium having the image and coated with the UV varnish was also measured by the method mentioned below.

Examples 2-15 and Comparative Examples 1-9

The procedure for formation and evaluation of the image in Example 1 was repeated except that the recording medium was changed as shown in Table 2 and the coating weight of the UV varnish was also changed as shown in Table 2.

Comparative Example 10

The procedure for formation and evaluation of the image in Example 1 was repeated except that an ink set 2 consisting of the black ink 2, yellow ink 2, magenta ink 2, and cyan ink 2 was used.

Comparative Example 11

The procedure for formation and evaluation of the image in Example 1 was repeated except that an ink set 3 consisting of the black ink 3, yellow ink 3, magenta ink 3, and cyan ink 3 was used.

Comparative Example 12

The procedure for formation and evaluation of the image in Example 1 was repeated except that the set of the dye-based color inks prepared above was used.

The evaluation items and evaluation methods are as follows.

1. Ink Absorbing Amount

The ink absorbing amount of a recording medium was measured with a dynamic scanning absorptometer (K350 TYPE D from Kyowa Seiko Co., Ltd.). In this regard, the cyan ink used for forming the image on the recording medium was used as the ink. The measurement conditions are as follows.

(1) Environmental conditions: 25° C. and 50% RH
(2) The ink absorption amount at the contact time of 500 ms is determined by an interpolation method from the ink absorption amount data at contact times near 500 ms.

2. Blurring of Character Images

Black character images were formed on a green solid image, and the evenness of the green solid image and blurring of the character images were visually evaluated. The evaluation was performed as follows.

Rank A: The solid image has good evenness, and in addition character images are not blurred.
Rank B: The solid image has good evenness, or character images are not blurred.
Rank C: The solid image has poor evenness, and character images are blurred.

3. Glossiness

The 60° glossiness of the green solid image was measured with a micro gloss meter from BYK-Gardner before and after coating the UV varnish to determine the difference in glossiness. The evaluation was performed as follows.

Rank A: The glossiness is improved by 30% or more by the UV varnish treatment.

Rank B: The glossiness is improved by 5% or more by the UV varnish treatment.

Rank C: The glossiness is improved by less than 5% by the UV varnish treatment.

4. Printing Property

A cyan ink for use in offset printing (HIUNITY NEO SOY from Toyo Ink Mfg. Co., Ltd.) was printed on the entire surface of the recording medium using a rotary ink tester (from Ishikawajima-Harima Heavy Industries Co., Ltd.), wherein the amount of the printed ink was 0.8 cc. The printed recording medium was allowed to settle for 8 hours under conditions of 23° C. and 65% RH. The printed recording medium was cut so as to have a size of 5 cm×5 cm. The cut recording medium was set on a sheet of an A2 coated paper (OK TOP COAT PLUS from Oji Paper Co., Ltd.) so that the inked surface is contacted with the A2 coated paper. The combination of the cut recording medium and the A2 coated paper was subjected to a calender treatment at a linear pressure of 5 kg/m. The cut recording medium was then released from the A2 coated paper, and the optical density of the portion of the A2 coated paper contacted with the cut recording medium was measured to determined whether the offset ink is transferred to the A2 coated paper. The evaluation was performed as follows.

Rank A: The optical density is lower than 0.05.

Rank B: The optical density is not lower than 0.05, and lower than 0.10.

Rank C: The optical density is higher than 0.10.

5. Overall Evaluation

The overall evaluation was performed as follows.

Rank A: The recorded image attains no rank C in the above-mentioned evaluations.

Rank C: The recorded image attains at least one rank C in the above-mentioned evaluations.

The evaluation results are shown in Table 2 and 3.

TABLE 2

| | Recording medium | | | Ink Solid | Ink absorbing | Coating weight of UV |
|---|---|---|---|---|---|---|
| | Name | SBR | Sub-strate | content (wt %) | amount (ml/m$^2$) | varnish (g/m$^2$) |
| Ex. 1 | MIRROR COAT PLATINUM | Yes | Paper | 7 | 1.4 | 2.40 |
| Ex. 2 | MIRROR COAT PLATINUM | Yes | Paper | 7 | 1.4 | 2.80 |
| Ex. 3 | MIRROR COAT PLATINUM | Yes | Paper | 7 | 1.4 | 3.84 |
| Ex. 4 | Recording paper 1 | Yes | Paper | 7 | 4.5 | 1.76 |
| Ex. 5 | Recording paper 1 | Yes | Paper | 7 | 4.5 | 2.56 |
| Ex. 6 | Recording paper 1 | Yes | Paper | 7 | 4.5 | 3.52 |
| Ex. 7 | POD GLOSS COAT | Yes | Paper | 7 | 6.0 | 1.92 |
| Ex. 8 | POD GLOSS COAT | Yes | Paper | 7 | 6.0 | 2.72 |
| Ex. 9 | POD GLOSS COAT | Yes | Paper | 7 | 6.0 | 3.04 |
| Ex. 10 | Recording paper 2 | Yes | Paper | 7 | 5.7 | 1.60 |

TABLE 2-continued

| | Recording medium | | | Ink Solid | Ink absorbing | Coating weight of UV |
|---|---|---|---|---|---|---|
| | Name | SBR | Sub-strate | content (wt %) | amount (ml/m$^2$) | varnish (g/m$^2$) |
| Ex. 11 | Recording paper 2 | Yes | Paper | 7 | 5.7 | 2.72 |
| Ex. 12 | Recording paper 2 | Yes | Paper | 7 | 5.7 | 3.36 |
| Ex. 13 | Recording paper 3 | Yes | Paper | 7 | 8.0 | 1.76 |
| Ex. 14 | Recording paper 3 | Yes | Paper | 7 | 8.0 | 2.88 |
| Ex. 15 | Recording paper 3 | Yes | Paper | 7 | 8.0 | 3.20 |
| Comp. Ex. 1 | CRISPIA | No | Resin coated paper | 7 | 15.0 | 2.24 |
| Comp. Ex. 2 | CRISPIA | No | Resin coated paper | 7 | 15.0 | 3.52 |
| Comp. Ex. 3 | CRISPIA | No | Resin coated paper | 7 | 15.0 | 4.48 |
| Comp. Ex. 4 | SUPER FINE | No | Paper | 7 | 25.0 | 2.40 |
| Comp. Ex. 5 | SUPER FINE | No | Paper | 7 | 25.0 | 3.84 |
| Comp. Ex. 6 | SUPER FINE | No | Paper | 7 | 25.0 | 6.24 |
| Comp. Ex. 7 | TYPE 6200 | No | Paper | 7 | 38.0 | 2.40 |
| Comp. Ex. 8 | TYPE 6200 | No | Paper | 7 | 38.0 | 3.20 |
| Comp. Ex. 9 | TYPE 6200 | No | Paper | 7 | 38.0 | 4.48 |
| Comp. Ex. 10 | MIRROR COAT PLATINUM | Yes | Paper | 5 | 2.0 | 2.40 |
| Comp. Ex. 11 | MIRROR COAT PLATINUM | Yes | Paper | 7 | 0.9 | 2.40 |
| Comp. Ex. 12 | MIRROR COAT PLATINUM | Yes | Paper | 0 (dye ink) | 1.0 | 2.40 |

MIRROR COAT PLATINUM: Cast coated paper from Oji Paper Co., Ltd.

POD GLOSS COAT: Coated paper from Oji Paper Co., Ltd.

Recording papers 1, 2 and 3: Recording papers prepared above in Medium Preparation Examples 1-3, respectively.

CRISPIA: Photographic-print-use recording paper for inkjet printing from Seiko Epson Corp.

SUPER FINE: Recording paper for inkjet printing from Seiko Epson Corp.

TYPE 6200: Recording paper for electrophotography from Ricoh Co., Ltd.

SBR:

Yes: Styrene - butadiene copolymer is included in the recording medium.

No: Styrene - butadiene copolymer is not included in the recording medium.

TABLE 3

| | | Glossiness (image portion) | | | | | |
|---|---|---|---|---|---|---|---|
| | Blur-ring | Before treat-ment (%) | After treat-ment (%) | Differ-ence (%) | Rank | Print-ing prop-erty | Overall evalua-tion |
| Ex. 1 | B | 52 | 94 | 42 | A | B | A |
| Ex. 2 | B | 53 | 95 | 42 | A | B | A |
| Ex. 3 | B | 53 | 94 | 41 | A | B | A |
| Ex. 4 | B | 35 | 85 | 50 | A | B | A |
| Ex. 5 | B | 32 | 89 | 57 | A | B | A |
| Ex. 6 | B | 34 | 91 | 57 | A | B | A |
| Ex. 7 | A | 23 | 37 | 14 | B | B | A |
| Ex. 8 | A | 24 | 67 | 43 | B | B | A |
| Ex. 9 | A | 23 | 77 | 54 | B | B | A |
| Ex. 10 | A | 23 | 37 | 14 | B | B | A |

TABLE 3-continued

| | Blurring | Glossiness (image portion) Before treatment (%) | After treatment (%) | Difference (%) | Rank | Printing property | Overall evaluation |
|---|---|---|---|---|---|---|---|
| Ex. 11 | A | 23 | 51 | 28 | B | B | A |
| Ex. 12 | A | 23 | 63 | 40 | B | B | A |
| Ex. 13 | A | 6 | 18 | 12 | B | B | A |
| Ex. 14 | A | 6 | 18 | 12 | B | B | A |
| Ex. 15 | A | 5 | 23 | 18 | B | B | A |
| Comp. Ex. 1 | A | 47 | 50 | 3 | C | C | C |
| Comp. Ex. 2 | A | 47 | 54 | 7 | B | C | C |
| Comp. Ex. 3 | A | 51 | 71 | 20 | B | C | C |
| Comp. Ex. 4 | A | 1 | 1 | 0 | C | C | C |
| Comp. Ex. 5 | A | 1 | 1 | 0 | C | C | C |
| Comp. Ex. 6 | A | 1 | 1 | 0 | C | C | C |
| Comp. Ex. 7 | B | 3 | 4 | 1 | C | B | C |
| Comp. Ex. 8 | B | 3 | 4 | 1 | C | B | C |
| Comp. Ex. 9 | B | 3 | 4 | 1 | C | B | C |
| Comp. Ex. 10 | C | 52 | 94 | 42 | A | B | C |
| Comp. Ex. 11 | C | 52 | 94 | 42 | A | B | C |
| Comp. Ex. 12 | C | 52 | 94 | 42 | A | B | C |

It can be understood from Tables 2 and 3 that the image recording method of the present invention can provide prints superior to prints formed by conventional inkjet recording methods.

The prints formed by the image recording method of the present invention have almost the same quality and appearance as those of photographic prints. In addition, the prints have good abrasion resistance, and cause no problems even when the prints are handled just after printing.

The image recording method of the present invention can be used for recording methods using an ink such as inkjet recording and offset printing. Specifically, the image recording method of the present invention can be used for inkjet printers, facsimiles, copiers, multifunctional image forming apparatus having printer/facsimile/copier functions, and printing machines.

This document claims priority and contains subject matter related to Japanese Patent Application No. 2009-021162, filed on Feb. 2, 2009, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image recording method comprising:

ejecting an ink to form an image on a surface of a recording layer of a recording medium, wherein the ink includes a particulate colorant, a surfactant and water, and has a solid content of not lower than 6% by weight, wherein the recording layer is located overlying a substrate including cellulose pulp as a main component and includes an inorganic pigment and a styrene-butadiene copolymer, and wherein a surface of the recording medium bearing the recording layer absorbs the ink in an amount of from 1 $ml/m^2$ to 10 $ml/m^2$ when the amount is measured with a dynamic scanning absorptometer at a contact time of 500 ms; and then applying a glossiness imparting liquid on the surface of the recording medium.

2. The image recording method according to claim 1, wherein the glossiness imparting liquid includes an UV crosslinkable material.

3. The image recording method according to claim 2, further comprising:

irradiating the surface of the recording medium with ultraviolet light after applying the glossiness imparting liquid to crosslink the UV crosslinkable material.

4. The image recording method according to claim 1, wherein the amount of the ink absorbed by the surface of the recording medium is from 5 $ml/m^2$ to 7 $ml/m^2$.

5. The image recording method according to claim 1, wherein the glossiness imparting liquid has a viscosity of not lower than 10 mPa·s at 25° C.

6. The image recording method according to claim 1, wherein the ink has a surface tension of from 15 mN/m to 30 mN/m.

7. The image recording method according to claim 1, wherein the surfactant is a fluorine-containing surfactant.

8. The image recording method according to claim 1, wherein the surface of the recording medium has a glossiness of not lower than 50% after the glossiness imparting liquid is applied thereon when the glossiness is measured at an angle of 60° by the method defined in JIS-ZS-8741.

* * * * *